US008740166B2

(12) United States Patent
Hamilton et al.

(10) Patent No.: US 8,740,166 B2
(45) Date of Patent: Jun. 3, 2014

(54) KEYBOARD AND MOUSE SUPPORT

(75) Inventors: Larry Hamilton, Mt. Prospect, IL (US); Taiwon Choi, Glenview, IL (US); Michael Jensen, Roselle, IL (US); ChunSheng Li, ShunLing Town (CN); Douglas Carpiaux, Milwaukee, WI (US); Adam Shileny, West Bend, WI (US); Heidi Anna Dondlinger, Bayside, WI (US); Martin Behling, II, Allenton, WI (US)

(73) Assignee: Fellowes, Inc., Itasca, IL (US)

( * ) Notice: Subject to any disclaimer, the term of this patent is extended or adjusted under 35 U.S.C. 154(b) by 340 days.

(21) Appl. No.: 13/029,727

(22) Filed: Feb. 17, 2011

(65) Prior Publication Data

US 2012/0210914 A1 Aug. 23, 2012

(51) Int. Cl.
*A47F 5/00* (2006.01)
*F16M 11/00* (2006.01)

(52) U.S. Cl.
USPC ..... 248/281.11; 248/286.1; 248/918; 108/93; 108/129

(58) Field of Classification Search
USPC ..... 248/281.11, 371, 372, 1, 393, 397, 398, 248/918, 298.1, 286.1; 108/93, 97, 129
See application file for complete search history.

(56) References Cited

U.S. PATENT DOCUMENTS 4,616,798 A * 10/1986 Smeenge et al. ..... 248/281.11
4,863,124 A * 9/1989 Ball et al. ..... 108/28
4,926,722 A 5/1990 Sorensen et al.
5,351,897 A 10/1994 Martin
5,636,822 A 6/1997 Hendershot et al.
5,667,320 A 9/1997 Ambrose et al.
5,730,408 A 3/1998 McAllister et al.
5,775,657 A * 7/1998 Hung ..... 248/289.11
5,915,657 A 6/1999 Ptak
5,975,474 A * 11/1999 Kaplan et al. ..... 248/289.11
6,079,676 A 6/2000 Hackett et al.
6,086,034 A 7/2000 McAllister et al.

(Continued)

FOREIGN PATENT DOCUMENTS

GB 2237507 A 8/1991

OTHER PUBLICATIONS

3M AKT65LE Adjustable Keyboard Tray Owner's Manual, 2009.

(Continued)

*Primary Examiner* — Anita M King
(74) *Attorney, Agent, or Firm* — Pillsbury Winthrop Shaw Pittman LLP

(57) ABSTRACT

A support device including a keyboard platform and a bracket for mounting the keyboard platform a work surface to elevate the keyboard platform above the work surface. The keyboard platform is mounted on the bracket for sliding movement relative to an edge of the work surface along a horizontal fore-aft axis. The keyboard platform is mounted on the bracket for tilting movement about a tilting axis perpendicular to the fore-aft axis. The support device includes a lock movable between a locked position wherein sliding/tilting movement of the keyboard platform is prevented and an unlocked position wherein sliding/tilting movement of the keyboard platform is permitted. One aspect includes a clamp provided on the bracket and engageable with the work surface to elevate the keyboard platform above the work surface. One aspect provides a mouse platform pivotally attached to the keyboard platform and configured to support the mouse at a tilted position.

39 Claims, 18 Drawing Sheets

(56) References Cited

U.S. PATENT DOCUMENTS

| | | | | |
|---|---|---|---|---|
| 6,116,557 | A | 9/2000 | Choy et al. | |
| D439,910 | S | 4/2001 | Tonizzo et al. | |
| 6,270,047 | B1 | 8/2001 | Hudson | |
| 6,279,859 | B2 | 8/2001 | West et al. | |
| D455,756 | S | 4/2002 | Tonizzo et al. | |
| 6,384,812 | B1 * | 5/2002 | Dunn | 345/168 |
| 6,390,432 | B1 | 5/2002 | Vanderheide et al. | |
| D463,441 | S | 9/2002 | Benden et al. | |
| 6,527,235 | B1 | 3/2003 | Cotterill | |
| 6,533,479 | B2 | 3/2003 | Kochanski | |
| 6,688,563 | B1 * | 2/2004 | Waxham et al. | 248/118.1 |
| 6,726,168 | B2 | 4/2004 | Barber | |
| 6,874,736 | B1 | 4/2005 | Jones et al. | |
| 6,883,764 | B1 | 4/2005 | Mileos et al. | |
| 6,971,624 | B2 | 12/2005 | Kollar et al. | |
| 7,086,634 | B1 | 8/2006 | Kirchhoff | |
| 7,147,190 | B2 | 12/2006 | Welles et al. | |
| 7,331,556 | B1 | 2/2008 | Brennan | |
| 7,455,270 | B2 | 11/2008 | Maloney et al. | |
| D588,145 | S | 3/2009 | Benden et al. | |
| 7,523,905 | B2 | 4/2009 | Timm et al. | |
| 7,566,039 | B2 * | 7/2009 | Hung | 248/278.1 |
| 7,575,205 | B2 | 8/2009 | Kirchhoff | |
| 7,752,981 | B2 | 7/2010 | Blackburn | |
| 7,823,520 | B2 * | 11/2010 | Mayben | 108/129 |
| 7,841,569 | B2 | 11/2010 | Mileos et al. | |
| 7,841,570 | B2 | 11/2010 | Mileos et al. | |
| 8,272,600 | B2 * | 9/2012 | Copeland et al. | 248/118.5 |
| 2002/0070325 | A1 | 6/2002 | Anguiano | |
| 2002/0117588 | A1 | 8/2002 | Lando | |
| 2002/0166938 | A1 | 11/2002 | Jacobs | |
| 2002/0195533 | A1 | 12/2002 | Gilberton | |
| 2004/0007651 | A1 | 1/2004 | Williams et al. | |
| 2004/0178304 | A1 | 9/2004 | Lando | |
| 2005/0098689 | A1 | 5/2005 | Sykes | |
| 2005/0224679 | A1 | 10/2005 | Sohn et al. | |
| 2006/0157628 | A1 | 7/2006 | Mileos et al. | |
| 2007/0001077 | A1 | 1/2007 | Kirchhoff | |
| 2007/0069097 | A1 | 3/2007 | Hsieh | |
| 2008/0111047 | A1 | 5/2008 | Abrams | |
| 2008/0173777 | A1 | 7/2008 | Yamamoto et al. | |
| 2008/0191110 | A1 | 8/2008 | Wainland | |
| 2009/0032666 | A1 | 2/2009 | Kuo | |
| 2009/0090832 | A1 | 4/2009 | Mileos et al. | |
| 2009/0152427 | A1 | 6/2009 | Kuo | |
| 2009/0314913 | A1 | 12/2009 | Gillis | |
| 2010/0200712 | A1 | 8/2010 | Mileos et al. | |
| 2010/0230557 | A1 | 9/2010 | Healey | |

OTHER PUBLICATIONS

International Search Report and Written Opinion regarding PCT/US2012/023806, mailed Aug. 2, 2012, 18 pages.

* cited by examiner

KEYBOARD AND MOUSE SUPPORT

BACKGROUND OF THE INVENTION

1. Field of Invention

The present invention is generally related to a keyboard support.

2. Background

Keyboard supports are generally used to support a computer keyboard and/or other data entry/interface device (e.g., mouse) relative to a work surface (typically a desktop) on which a computer screen rests. The keyboard supports are typically connected to the underside of the work surface and have adjustment mechanisms that enable the keyboard support to be moved closer to the user. For example, some keyboard supports have linkage mechanisms that enable the keyboard support to be moved between a stored position wherein the keyboard support is stored below the work surface and an operative position wherein the keyboard support is extended from the work surface. To install or uninstall keyboard supports to and from the underside of the work space, tools are typically required, which may add time and complexity to the installation and uninstallation process. Furthermore, the linkage mechanism or other attachment mechanism used to attach the keyboard support to the underside of the work surface requires additional room under the work surface and therefore may occupy leg room of the user.

SUMMARY OF THE INVENTION

One aspect of the invention provides a support device including a keyboard platform having a top surface and a bottom surface. The top surface is configured to support a computer keyboard. The support device also includes a bracket constructed and arranged to mount the keyboard platform to an edge of a work surface such that the keyboard platform is elevated above the work surface. The keyboard platform is mounted on the bracket for sliding movement with respect to the edge of the work surface along a substantially horizontal fore-aft axis. The keyboard platform is further mounted on the bracket for tilting movement about a tilting axis substantially perpendicular to the fore-aft axis. The support device also includes a lock movable between a locked position wherein sliding and tilting movement of the keyboard platform with respect to the edge of the work surface is prevented and an unlocked position wherein sliding and tilting movement of the keyboard platform with respect to the edge of the work surface is permitted.

Another aspect of the invention provides a support device that includes a keyboard platform having a top surface and a bottom surface. The top surface is configured to support a computer keyboard. The support device also includes a bracket constructed and arranged to mount the keyboard platform to a work surface. A clamp is provided on the bracket and is engageable with the work surface such that the bracket is operable to position the keyboard platform elevated above the work surface. The clamp includes at least a pair of opposing surfaces for receiving an edge of the work surface therebetween. At least one of said opposing surfaces is movable to enable relative clamping movement of the opposing surfaces towards one another to clamp the edge of the work surface therebetween, and relative releasing movement of the opposing surfaces away from one another to unclamp the edge of the work surface. The clamp further includes a brake constructed and arranged to be moveable between an engaged position and a disengaged position. When the brake is in the engaged position, relative clamping movement of the opposing surfaces towards one another is permitted and relative releasing movement of the opposing surfaces away from one another is prevented. When the brake is in the disengaged position, the relative clamping movement of the opposing surfaces towards one another is permitted and the relative releasing movement of the opposing surfaces away from the one another is permitted.

Other objects, features, and advantages of the present invention will become apparent from the following detailed description, the accompanying drawings, and the appended claims.

DETAILED DESCRIPTION OF EMBODIMENT(S) OF THE INVENTION

Figure 1A:
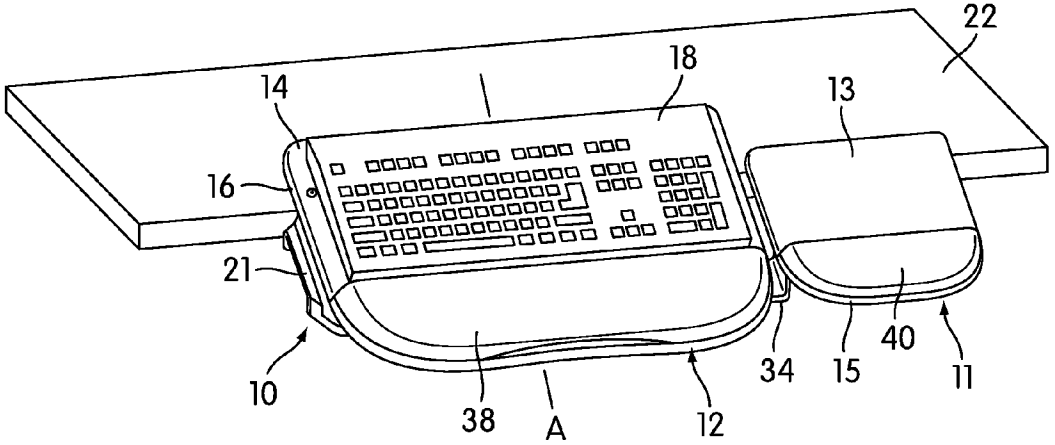
FIG. 1*a* is a perspective view of a keyboard and mouse support in accordance with an embodiment.
Figure 2:
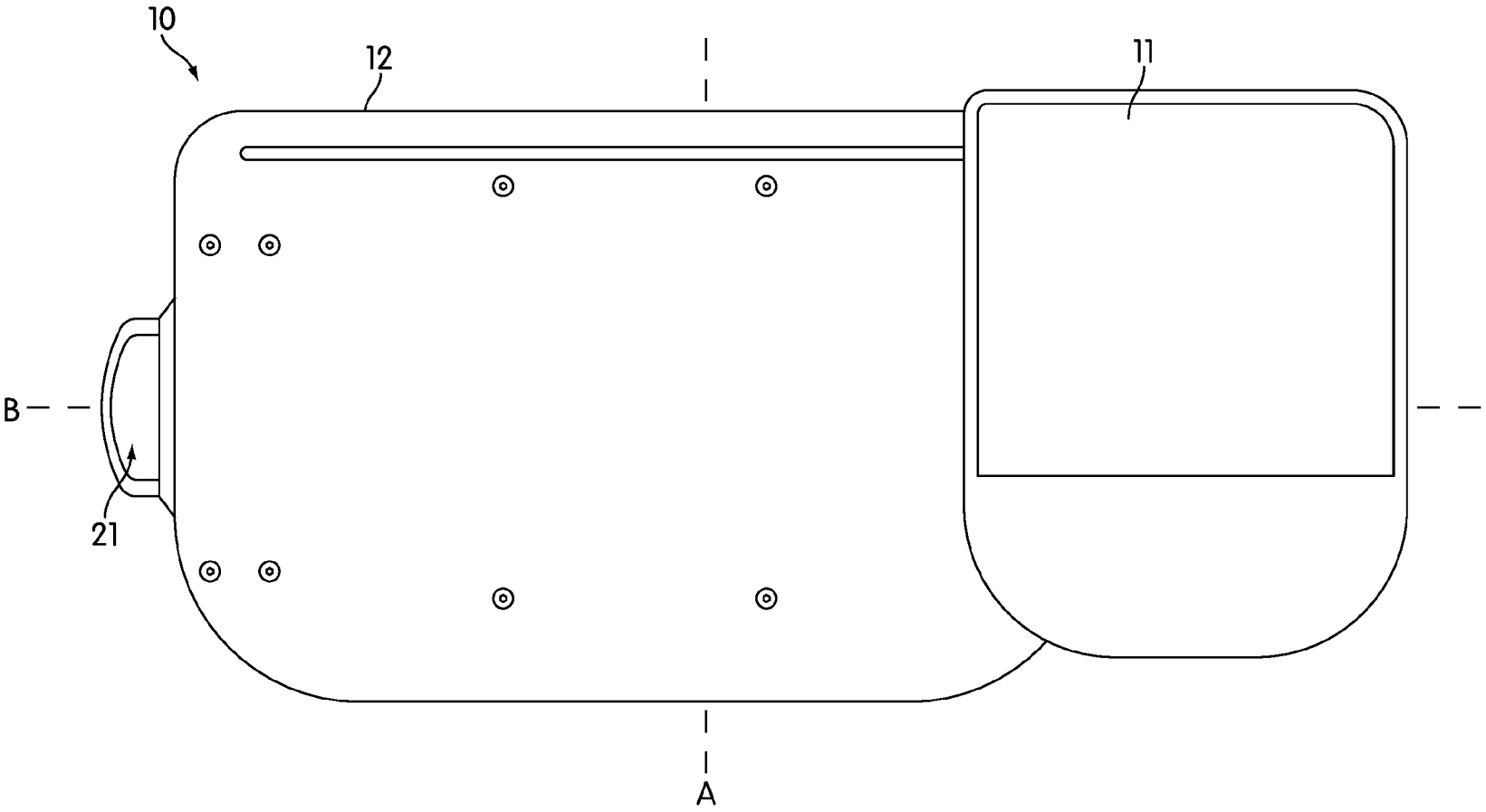
FIG. 2 is a top view of the keyboard and mouse support in accordance with the embodiment of FIG. 1.
Figure 3:
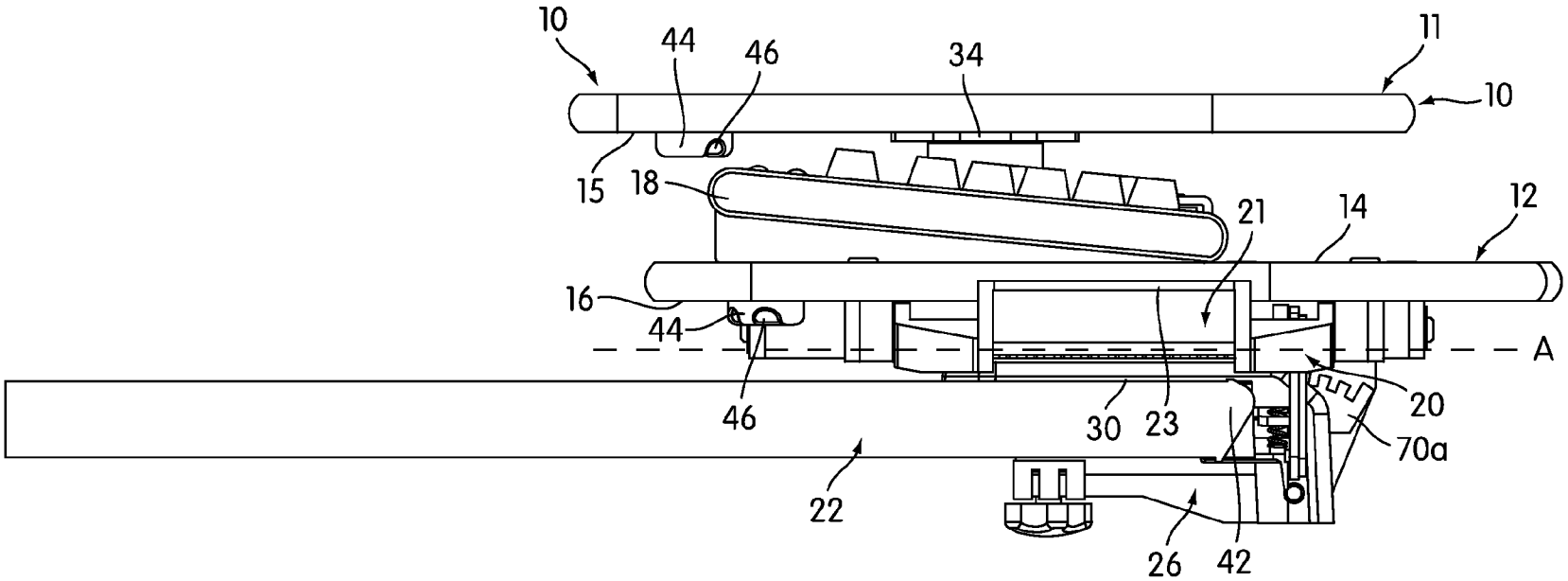
FIG. 3 is a side view of the keyboard and mouse support in accordance with the embodiment of FIG. 1.

FIG. 1*a* illustrates a non-limiting embodiment of a keyboard and mouse support device 10 that includes a keyboard platform 12 having a top surface 14 and a bottom surface 16, and an optional mouse platform 11 having a top surface 13 and a bottom surface 15. The keyboard platform top surface 14 of the keyboard platform 12 is configured to support a computer keyboard 18 thereon. A bracket 20 (see FIG. 3) is constructed and arranged to mount the keyboard platform 12 to a work surface 22 such that the keyboard platform 12 is elevated above the work surface 22. In the embodiment shown in FIG. 3, the keyboard platform 12 is mounted on the bracket 20 for sliding movement with respect to an edge 42 of the work surface 22 along a substantially horizontal fore-aft axis A. In addition, as shown in FIG. 3, the keyboard platform 12 is mounted on the bracket 20 for tilting movement about a tilting axis B (see FIG. 2) that is substantially perpendicular to the fore-aft axis A. Accordingly, the keyboard platform 12 is adjustable with respect to the work surface 22 by the user. It should be appreciated that the term "keyboard" as used herein is not limited to a standard computer keyboard, Just for example, the keyboard may be part of a computing device, such as Tablet Computers (including those with a keyboard displayed on a graphical user interface, such as the iPad® from Apple, Inc.), lap tops, and type writers. The keyboard may also be any user interface configured to receive user input (e.g., keyboard of a musical instrument). In addition, the keyboard platform 12 is not limited to supporting only a standard keyboard associated with computers. For example, the keyboard platform 12 may be used to support standard keyboards, other types of keyboards, a computing device such as those listed above, or any other devices or apparatuses.

Figure 4:
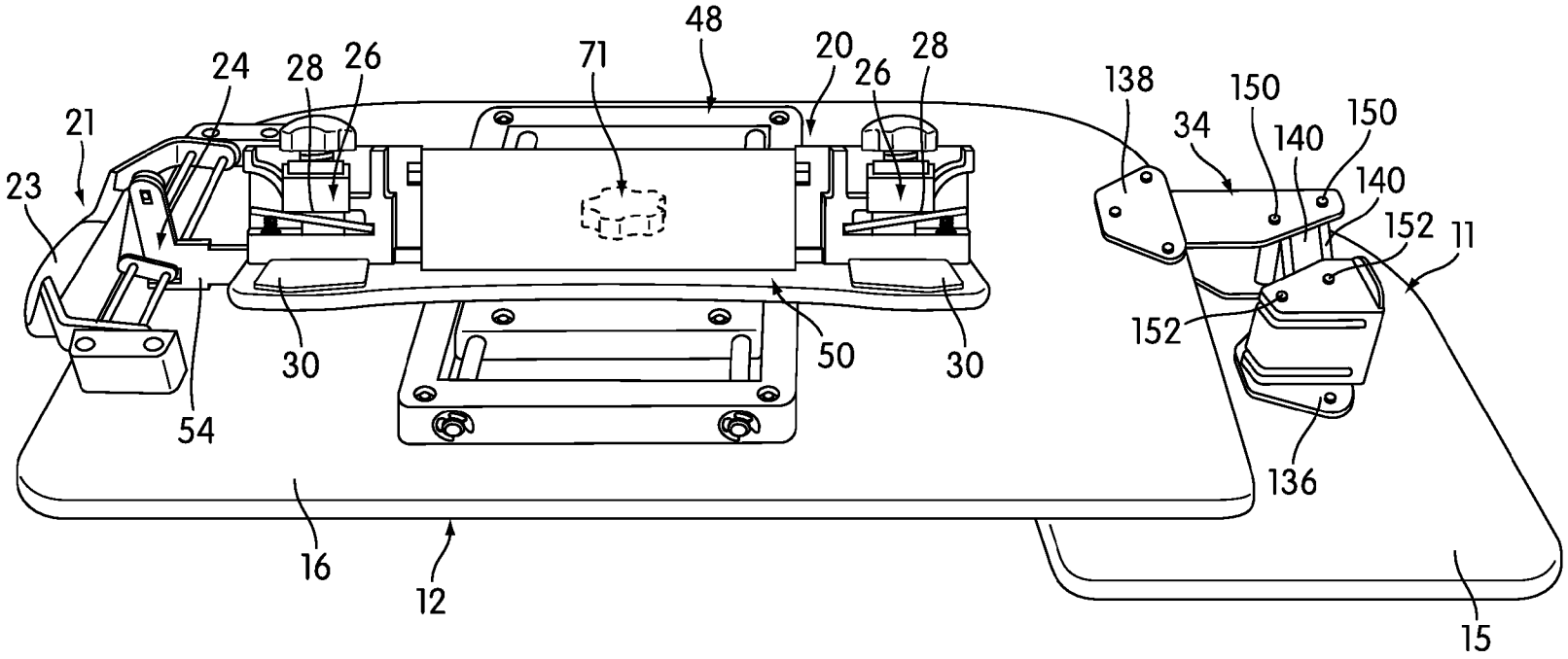
FIG. 4 is a view of a bottom of the keyboard and mouse support from above with the mouse support in a retracted position.

In the embodiment shown in FIG. 4, the keyboard and mouse support device 10 also includes a lock 24 that is movable between a locked position wherein sliding and tilting movement of the keyboard platform 12 and mouse platform 11 with respect to the edge 42 of the work surface 22 is prevented, and an unlocked position wherein sliding and tilting movement of the keyboard platform 12 and mouse platform 11 with respect to the edge 42 of the work surface 22 is permitted. The lock 24 includes a handle 21 that may be actuated to move the lock 24 from the locked position to the unlocked position. Thus, when the handle 21 is unactuated, the lock 24 is in the locked position, and when the handle 21 is actuated, the lock 24 is in the unlocked position. The handle 21 may be positioned on a side of the keyboard platform 12 opposite the mouse platform 11. However, it should be appreciated that the handle 21 may be positioned in other locations in other embodiments. The handle 21 may be provided with a contact surface 23 such that the user may pull the handle 21 via the contact surface 23 to actuate the handle 21. The lock 24 may also include a locking bar 54 moveable between 1) an engaged position wherein the locking bar 54 is engaged to engaging members of the bracket 20 to prevent the sliding movement and tilting movement of the keyboard platform 12 and mouse platform 11 to provide the locked position and 2) a disengaged position wherein the locking bar is disengaged from engaging members of the bracket 20 to permit the sliding and/or tilting movement of the keyboard platform 12 and mouse platform 11 to provide the unlocked position. Further details regarding the lock 24 and its functions are provided below.

Referring back to FIG. 1*a*, the top surface 13 of the mouse platform 11 is configured to support a computer mouse 17 thereon. In one embodiment, the keyboard platform 12 is attached to the work surface 22 using the bracket 20, and the mouse platform 11 is attached to the keyboard platform 12 via an attachment structure 34. In such an embodiment, the mouse platform 11 is pivotally attached to the keyboard platform 12 via the attachment structure 34 and may be pivoted between a retracted position wherein the mouse platform 11 is positioned above a portion of the keyboard platform (see FIG. 2) and an extended position wherein the mouse platform is horizontally displaced relative to the keyboard platform (see FIG. 1*a*) Alternatively, in the embodiment shown in FIG. 1*b*, the mouse platform 11 is integrally formed with the keyboard platform 12. In some embodiments, the mouse platform 11 may also be fixed to the keyboard platform 12. It should be appreciated that the positioning of the mouse platform 11 relative to the keyboard platform 12 is not limited to these examples and that the mouse platform 11 may be positioned in various locations in other embodiments. It is also contemplated that in some embodiments, the mouse platform 11 may be removed and only the keyboard platform 12 may be provided.

Figure 1B:
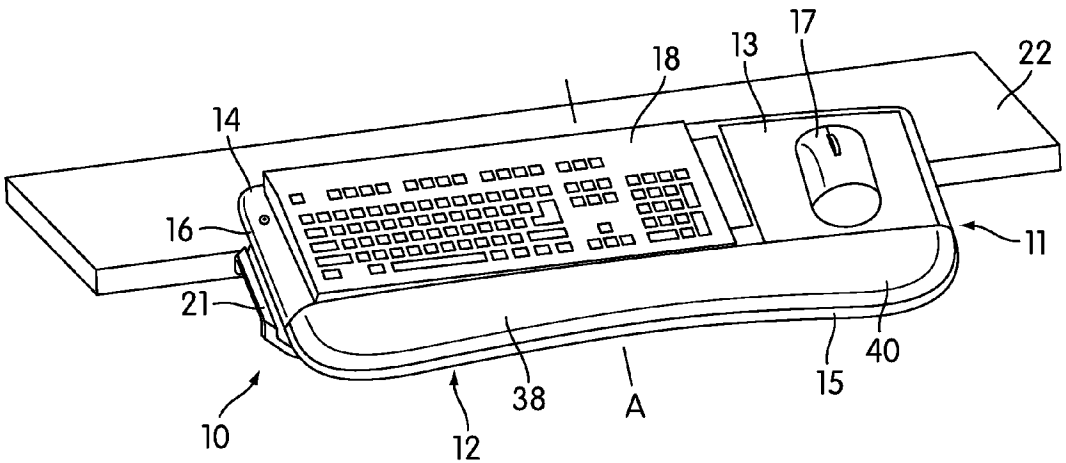
FIG. 1*b* is a perspective view of the keyboard and mouse support in accordance with another embodiment.

In the embodiment shown in FIG. 1*a*, the keyboard platform 12 includes a first wrist support 38 and the mouse platform 11 includes a second wrist support 40. The first and second wrist supports 38, 40 are constructed and arranged to enable a user to rest his/her wrist thereon when operating the keyboard 18 and/or the mouse 17, respectively. The first and second wrist supports 38, 40 may be separate structures. Alternatively, the first and second wrist supports 38, 40 may be attached to one another or may be integrally formed, as shown in FIG. 1*b*. The first and second wrist supports 38, 40 may be contoured to fit the shape of the keyboard platform 12 and the mouse platform 11. The first and/or second wrist supports 38, 40 may be optional in some embodiments.

FIG. 3 illustrates a side view of the keyboard and mouse support device 10 in accordance with the embodiment of FIG. 1*a*. In the illustrated embodiment, the keyboard and mouse support device 10 is attached to the edge 42 of the work surface 22 via a clamp 26. The clamp 26 is provided on the bracket 20 and is engageable with the work surface 22 such that the bracket 20 is operable to position the keyboard platform 12 elevated above the work surface 22.

The clamp 26 includes a pair of opposing surfaces 28, 30 for receiving an edge of the work surface 22 therebetween. In one embodiment surface 28 may be a moveable surface (see FIG. 4) and surface 30 may be a fixed surface opposing the moveable surface 28. However, it should be appreciated that either or both surfaces 28, 30 may be moveable in other embodiments. In the embodiment shown in FIG. 3, a portion of the edge 42 of the work surface 22 is received between the fixed and movable surfaces 28, 30. The movable surface 28 is movable towards the fixed surface 30 to clamp the work surface 22 therebetween. In one embodiment, the clamp 26 further includes a brake 32 (see FIG. 13), which includes a lever in this embodiment, constructed and arranged to be moveable between an engaged position and a disengaged position. The brake 32, when in the engaged position, permits movement of the movable surface 28 towards the fixed surface 30 and prevents movement of the movable surface 28 away from the fixed surface 30. In contrast, the brake 32, when in the disengaged position, permits movement of the movable surface 28 towards the fixed surface 30 and permits movement of the movable surface 28 away from the fixed surface 30. In one embodiment, the fixed surface 30 is provided on a portion of the bracket 20. However, in other embodiments, it is contemplated that the fixed surface 30 may be separate from the bracket 20. It should also be appreciated that the brake may take other forms in other embodiments. For example, the brake may be any structure that stops movement of the opposing surfaces 28, 30 away from each and/or towards each other. In one embodiment, the brake 32 may include a ratchet. Details of the clamp 26 and the operation thereof will be described in more detail below.

In the embodiment shown in FIG. 3, the mouse platform 11 is separate from the keyboard platform 12 and is elevated with respect to the keyboard platform 12 and the keyboard 18. As such, when the mouse platform 11 is in the retracted position, the mouse platform 11 may be positioned above the keyboard platform 12 and the keyboard 18, as shown in FIG. 2. Referring back to FIG. 3, wire routers 44 may be provided on the bottom surface 15 of the mouse platform 11 and the bottom surface 16 of the keyboard platform 12 to receive and route mouses and keyboard wires, respectively. The wire routers 44 include recesses 46 that are constructed and arranged to receive and retain the mouse and keyboard wires.

Figure 5:
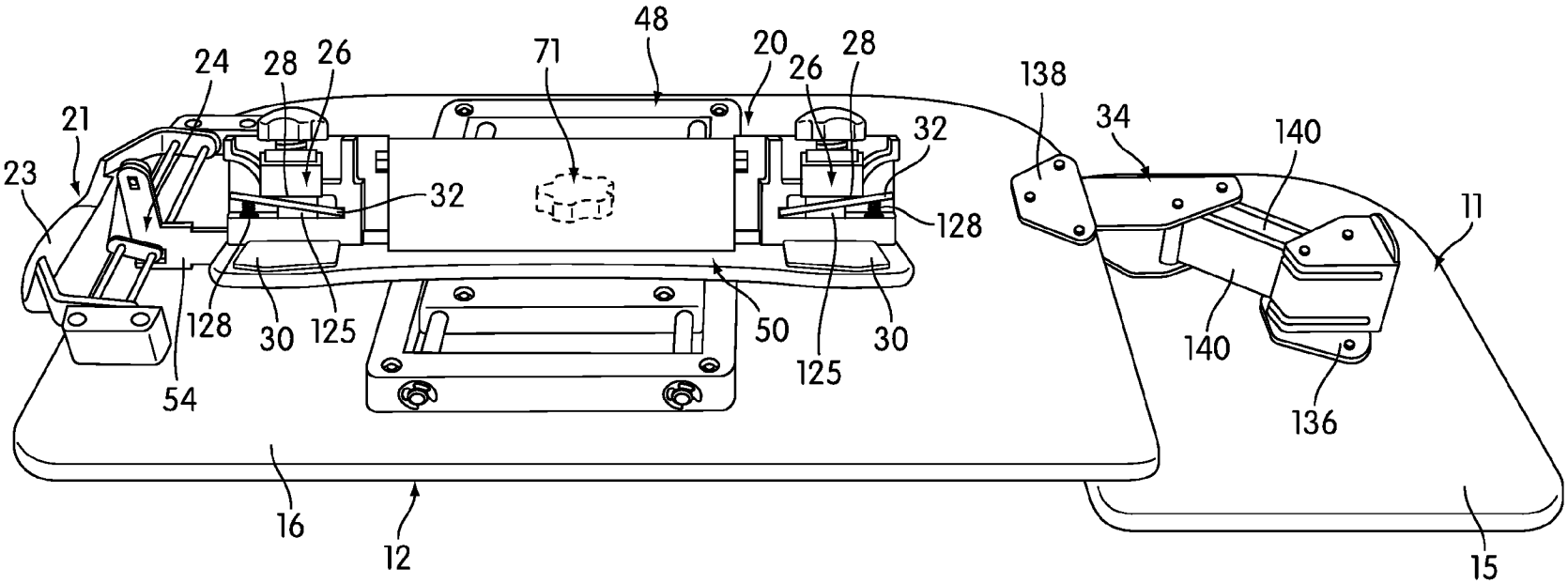
FIG. 5 is a view of the bottom of the keyboard and mouse support from above with the mouse support in an extended position.

FIGS. 4-5 are views of the bottom of the keyboard and mouse support device 10 with the mouse platform 11 in a retracted position and an extended position, respectively. In the illustrated embodiment, the mouse platform 11 may be pivotally connected to the keyboard platform 12 using the attachment structure 34. The attachment structure 34 may be connected to the bottom surface 15 of the mouse platform 11 on one end and to the bottom surface 16 of the keyboard platform 12 at the other end. The keyboard and mouse platforms 11, 12 may be attached to the work surface 22 using the bracket 20 and the clamps 26 (two are provided in this embodiment). In the illustrated embodiment, the bracket 20 is attached to the bottom surface 16 of the keyboard platform 12, the clamps 26 are provided on the bracket 20, and the mouse platform 11 is attached to the keyboard platform 12 such that the mouse platform 11 can be indirectly attached to the work surface 22. In this embodiment, the bracket 20 includes a frame structure 48 and a chassis 50. The chassis 50 and the frame structure 48 may operate together to enable sliding and tilting movement of the keyboard platform 12, which will be described in more detail below.

Figure 6:
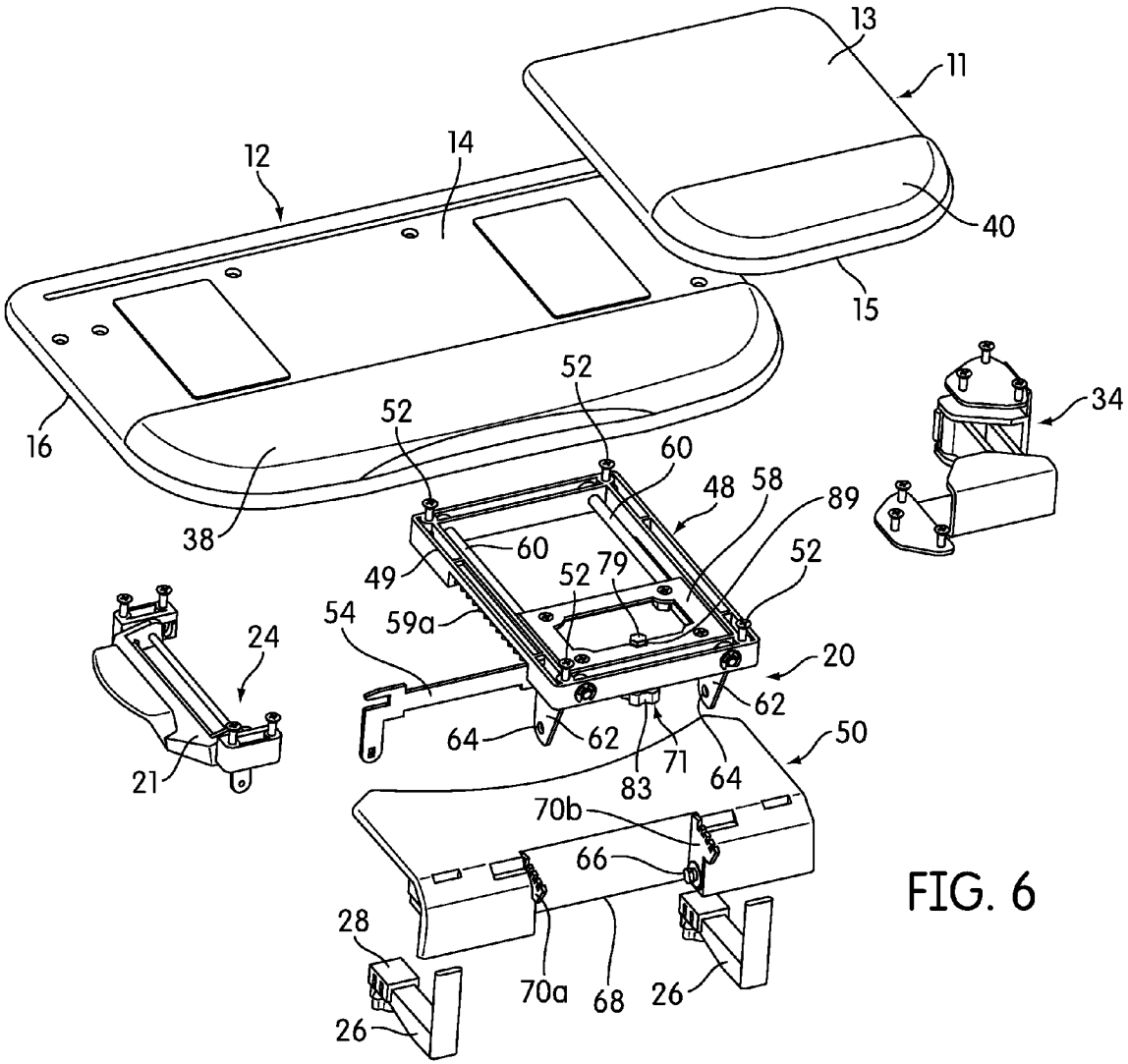
FIG. 6 is an exploded view of the keyboard and mouse support of FIG. 1.

FIG. 6 shows an exploded view of the components of the keyboard and mouse support device 10 of FIG. 1. In the illustrated embodiment, the frame structure 48 includes an outer structure 49 and an inner structure 58. The outer structure 49 of the frame structure 48 may be fixed to the bottom surface 16 of the keyboard platform 12 using screws 52, although other attachment mechanisms may be used. It should be noted, however, that the terms "inner" and "outer" used herein with respect to the structures refer to their positions relative to each other in this embodiment and that the positions may change in other embodiments.

In one embodiment, the inner structure 58 is operatively connected to the chassis 50 via extensions 62 that extend downwards towards the chassis 50. In such embodiment, the extensions 62 include openings 64 that are constructed and arranged to receive pivot pins 66 that pivotally connect the extensions 62 to the chassis 50. Accordingly, the frame structure 48 is pivotable relative to the chassis 50 along a pivot axis defined by the pivot pins 66. Thus, the pivotal connection of the frame structure 48 and the chassis 50 via the pivot pins 66 enable the tilting movement of the keyboard and mouse platforms 11, 12.

In the illustrated embodiment, the clamps 26 (two are provided in this embodiment) are provided on the chassis 50. The fixed surface 30 (obstructed from view in this Figure) of the clamp 26 may be provided on the chassis 50 of the bracket 20. Accordingly, the work surface 22 may be clamped between the chassis 50 and the movable surface 28 of the clamp 26, as shown in FIG. 3. Referring back to FIG. 6, the chassis 50 may also include a cutout 68 formed therein, and the pivot pins 66 may be provided in the cutout 68. A pair of teeth structures 70*a*, 70*b* fixed on the chassis 50 may be provided in the cutout 68 and may be connected to the rest of the chassis 50 via the pivot pins 66. The teeth or ridges formed on the teeth structure 70*a*, 70*b* may be constructed and arranged to engage with the locking bar 54 of the lock 24 when the lock 24 is in the locked position to prevent tilting movement of the keyboard and mouse platforms 11, 12, which will be described in more detail later.

Figure 7:
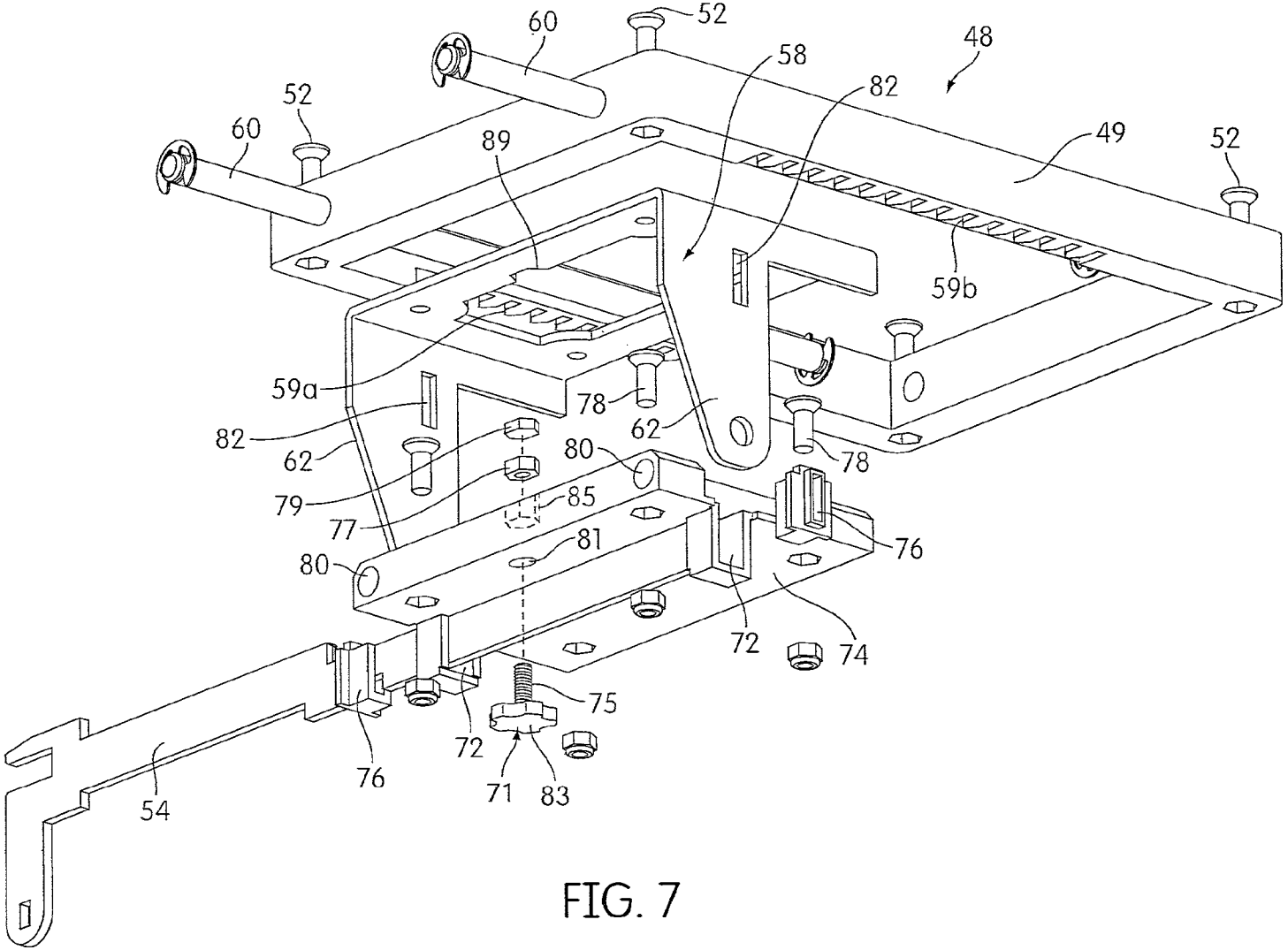
FIG. 7 is an exploded view of a frame structure and a locking bar.

FIG. 7 shows an exploded view of the frame structure 48 and the locking bar 54. In the illustrated embodiment, a mounting block 74 may be connected to the inner structure 58 using screws 78, although other attachment mechanisms may be used. The mounting block 74 includes openings 80 that are constructed and arranged to receive the rods 60 such that the mounting block 74 and the inner structure 58 may slide along the rods 60 relative to the outer structure 49. However, it should be noted that, as mentioned above, the inner structure 58 may be stationary because the inner structure 58 is attached to the chassis 50, which is mounted to the work surface 22. Thus, in such embodiment, sliding movement of keyboard platform 22, which is fixed to the outer frame 49, is achieved by the movement of the outer frame 49 and the rods 60 along the stationary mounting block 74 and the stationary inner structure 58. Thus, in such embodiment, the operative connection of the outer structure 49 to the inner structure 58 and the mounting block 74 using the rods 60 enables the sliding movement of the keyboard and mouse platforms 11, 12.

In the illustrated embodiment, the locking bar 54 is received in openings 72 of the mounting block 74. Sleeves 76, which may be optional in other embodiments, are received in the openings 72 to help retain the locking bar 54 therein. The inner structure 58 may be provided with slits 82 constructed and arranged to also receive the locking bar 54. As mentioned above, the outer structure 49 may be slideable with respect to the inner structure 58 and the mounting block 74. Thus, the outer structure 49 may also be slideable with respect to the locking bar 54 because of the operative connection of the locking bar 54 to the mounting block 74 and the inner structure 58. A plurality of ridges or teeth 59*a*, 59*b* may be provided on the outer frame 49 and may be constructed and arranged to engage with the locking bar 54 of the lock 24 when the lock 24 is in the locked position such that sliding movement of the keyboard and mouse platforms 11, 12 are prevented, which will be described in more detail later.

In one embodiment, the keyboard and mouse support device 10 includes a reinforcement structure 71 that includes a head portion 83 and a threaded portion 75, a nut 77, and an end cap 79. The reinforcement structure 71 may be constructed and arranged to reinforce the inner structure 58 and other parts of the bracket 20 with respect to the keyboard platform 12 to prevent or minimize extraneous or undesired movement (e.g., side to side movement and/or up and down movement) of the keyboard and mouse device 10 during operation of the keyboard 18 and/or mouse 17 supported thereon. The reinforcement structure 71 may be used with any embodiments of the keyboard platform 12 (for example the embodiments shown in FIGS. 1*a* and 1*b* or with other embodiments of the keyboard platform 12).

In one embodiment, the reinforcement structure 71 may be constructed and arranged to stabilize the keyboard and mouse support device 10 by preventing or minimizing extraneous or undesired movement of the keyboard and mouse support device 10 during operation thererof when the lock 24 is in the locked position. For example, in one embodiment, the reinforcement structure 71 may be constructed and arranged to push the inner structure 58 against the bottom surface 16 of the keyboard platform 12 to prevent or minimize extraneous or undesired movement of the keyboard platform 12 with respect to the inner structure 58 and other parts of the bracket 20. Alternatively or additionally, the reinforcement structure 71 may be constructed and arranged to push the end cap 79 against the bottom surface 16 of the keyboard platform 12 to prevent or minimize extraneous or undesired movement of the keyboard platform 12 with respect to parts of the bracket 20. The reinforcement structure 71 may be moved from 1) an engaged position wherein the end cap 79 and/or the inner structure 58 are pushed against the bottom surface 16 of the keyboard platform 12 so as to stabilize the mouse and keyboard support device 10 and 2) a disengaged position wherein the end cap 79 and/or the inner structure 58 are removed from contact with the bottom surface 16 of the keyboard platform 12 such that extraneous movement of the keyboard and mouse device 10 is permitted. In one embodiment, when the reinforcement structure 71 is in the engaged position, the handle 21 may be actuated to move the lock 24 to the unlocked position. In such embodiment, sliding movement of the keyboard platform 12 may be prevented when the reinforcement structure 71 is in the engaged position because of the contact between the end cap 79 and the bottom surface 16 of the keyboard platform 12 and/or the contact between the inner structure 58 and the bottom surface 16 of the keyboard platform 12. Accordingly, in such embodiment, the reinforcement structure 71 should be in the disengaged position to permit sliding movement of the keyboard platform 12 when the lock 24 is in the unlocked position. In some embodiments, after the lock 24 has been moved to the unlocked position by actuation of the handle 21, tilting movement of the keyboard platform 12 is permitted even when the reinforcement structure 71 is in the engaged position.

Figure 8:
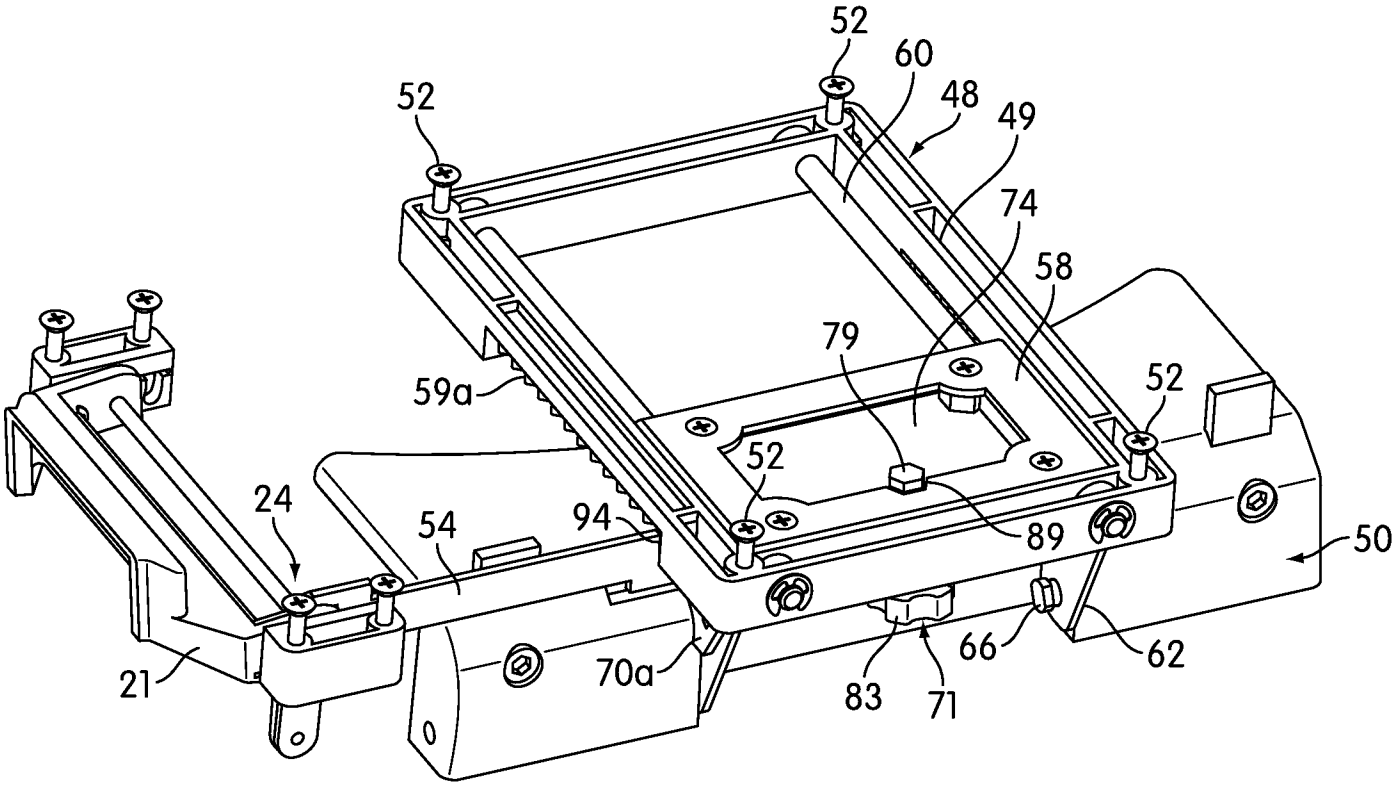
FIG. 8 is a perspective view of the frame structure, a handle, and the locking bar.

In the embodiment shown in FIG. 7, a threaded opening 81 is formed in the mounting block 74 to receive the threaded portion 75 of the reinforcement portion 71. In one embodiment, the nut 77 is hexagonal shaped and is received in a hexagonal-shaped recess 85 formed in the mounting structure 74. However, it is contemplated that the nut 77 may have other shapes and may be positioned at other locations. The end cap 79 may also be hexagonal shaped and at least a portion thereof may be received in a recess 89 formed in the inner structure 58, as shown in FIGS. 6 and 8. Referring back to FIG. 7, the nut 77 and the end cap 79 may also be constructed and arranged to receive a portion of the threaded portion 75 of the knob 73. Accordingly, the threaded portion 75 may be rotatable via the head portion 83 to push the end cap 79 against the bottom surface 16 of the keyboard platform 12 and/or to push the inner structure 58 against the bottom surface 16 of the keyboard platform 12. That is, the head portion 83 may be used to move the reinforcement structure 71 from 1) the engaged position wherein the end cap 79 and/or the inner structure 58 are pushed against the bottom surface 16 of the keyboard platform 12 so as to stabilize the mouse and keyboard support device 10 and 2) the disengaged position wherein the end cap 79 and/or the inner structure 58 are removed from contact with the bottom surface 16 of the keyboard platform 12 such that extraneous movement of the keyboard and mouse device 10 is permitted. Thus, to stabilize the inner structure 58 and other portions of the bracket 20 with respect to the keyboard platform 12, the knob 73 may be rotated via the head portion 83 to the engaged position such that the threaded portion 75 pushes the end cap 79 and/or the inner structure 58 against the bottom surface 16 of the keyboard platform 12 with sufficient force. Accordingly, the friction resulting from the contact between the end cap 79 and/or the inner structure 58 and the bottom surface 16 of the keyboard platform 12 may help reinforce or stabilize the keyboard and mouse support device 10. It should be appreciated that this example of the reinforcement structure 71 is not intended to be limiting, and that other embodiments or operation of the structure 71 may be used. It should also be appreciated that in some embodiments, the end cap 79 may be eliminated and an end of the threaded portion 75 opposite the head portion 83 may provide a similar function as the end cap 79.

FIG. 8 shows the inner structure 58 of the frame structure 48 pivotally connected to the chassis 50. The frame structure 48 and the chassis 50 may move relative to each other to enable sliding movement of the keyboard and mouse support device 10 in the fore-aft axis A (see FIG. 3) and tilting movement thereof about the axis B (see FIG. 2). In the illustrated embodiment, the lock 24 is in the locked position wherein the locking bar 54 is engaged with the teeth 59*a*, 59*b* to prevent sliding movement of the frame structure 48 relative to the chassis 50. In this embodiment, the pair of teeth structures 70*a*, 70*b* are arranged such that when the frame structure 48 is operatively connected to the chassis 50, the extensions 64 of the frame structure 48 are positioned between the teeth structures 70*a*, 70*b*. The frame structure 48 is constructed and arranged to be pivotable with respect to the chassis 50 at the pivot axis defined by the pivot pins 66 to enable tilting movement of the keyboard platform 12, which may be fixed to the outer structure 49 of the frame structure 48 using the screws 52. When the frame structure 48 is pivoted relative to the chassis 50, the position of the locking bar 54 may also move relative to the teeth structures 70*a*, 70*b* to enable the locking bar 54 to engage various teeth of the teeth structures 70*a*, 70*b* upon return to the locked position such that the keyboard and mouse platforms 11, 12 may be operated at a desired angle.

Figure 9A:
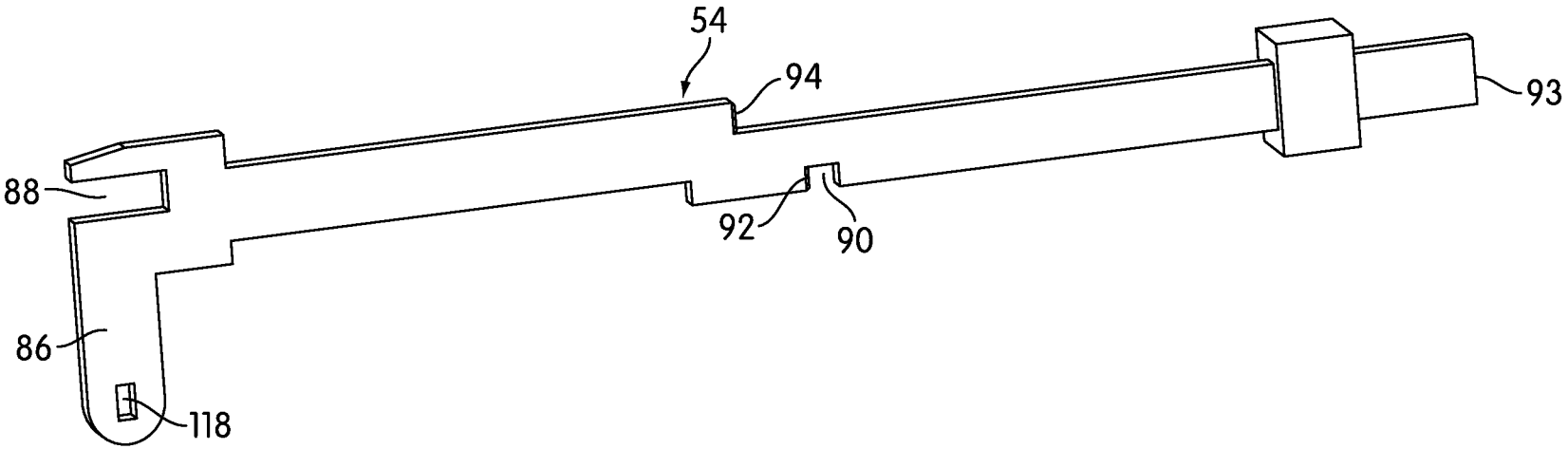
FIG. 9*a* is a detailed view of the locking bar.

FIG. 9*a* illustrates the locking bar 54 of the lock 24 in more detail. Referring to FIG. 9*a*, the locking bar 54 includes a connecting portion 86 on one end, the connecting portion 86 constructed and arranged to connect to the handle 21 such that actuation of the handle 21 may effect movement of the locking bar 54. On the same end, an opening 88 is formed in the locking bar 54. The opening 88 may be constructed and arranged to engage with a portion of the handle 21 during actuation of the handle 21. In this embodiment, the locking bar 54 includes a notch 90 constructed and arranged to receive the teeth of teeth structure 70*a* (see FIG. 9*b*) therein to enable tilting movement of the keyboard and mouse platforms 11, 12. That is, in such an embodiment, the notch 90 enables the locking bar 54 to move or tilt relative to the teeth of the stationary teeth structure 70*a* during tilting movement of the keyboard and mouse platforms 11, 12. A first engaging portion 92 of the locking bar 54 is provided adjacent the notch 90 and is constructed and arranged to engage with the teeth of the teeth structure 70*a* to lock the keyboard and mouse platforms 11, 12 at a desired operating angle after tilting movement thereof. The locking bar 54 may also include a second engaging portion 94 constructed and arranged to engage the set of teeth 59*a* on the frame structure 48 to prevent further sliding movement of the keyboard and mouse support device 10 after a desired position along the fore-aft axis A has been selected. A third engaging portion 93 may be provided on the locking bar 54 to engage the other set of teeth 59*b* and the other teeth structure 70*b* when the locking bar 54 is in the engaged position.

Figure 9B:
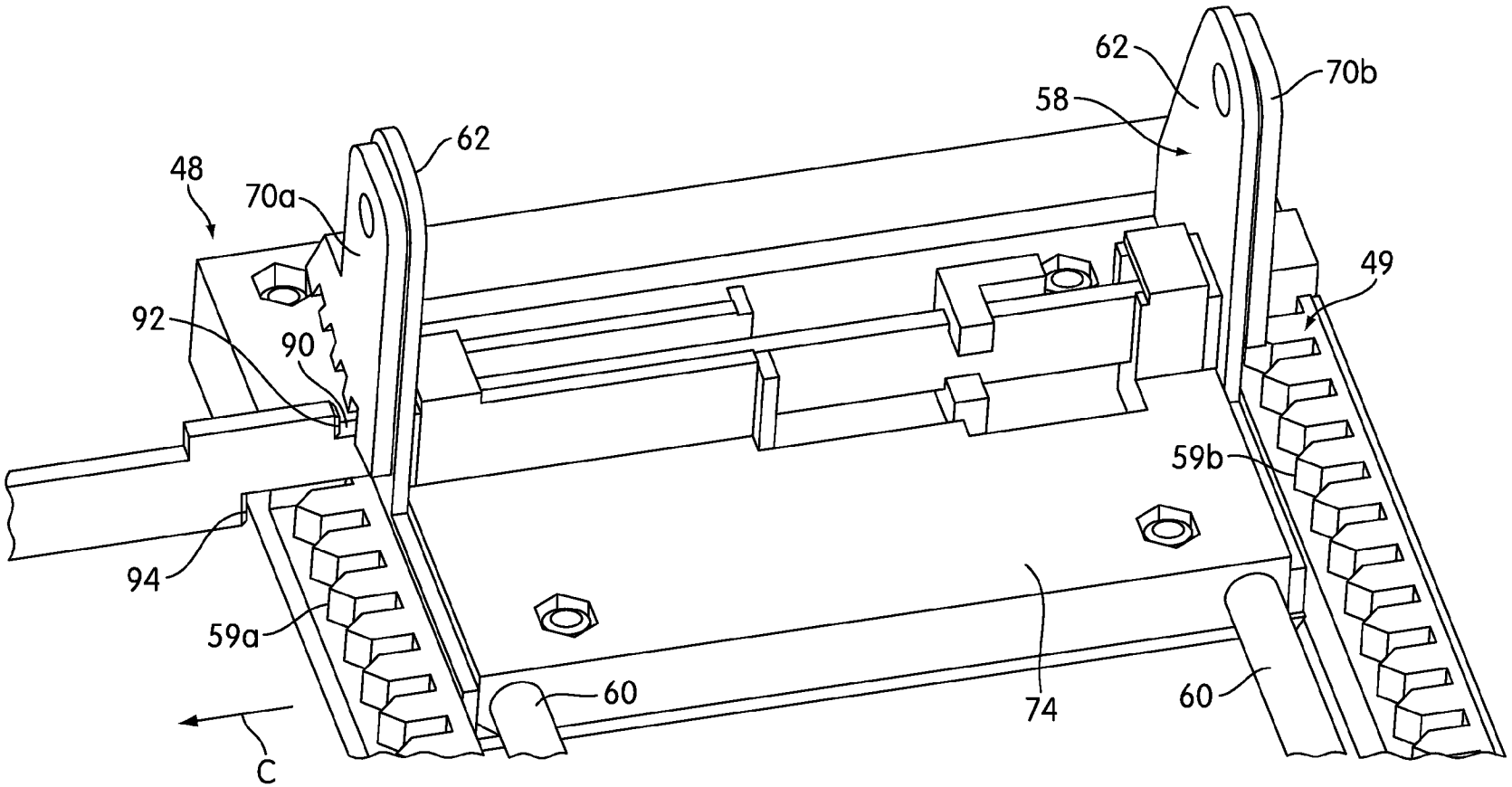
FIG. 9*b* shows portions of the frame structure and the locking bar.

FIG. 9*b* shows a detailed view from above of the bottom of the frame structure 48 and the locking bar 28. That is, FIG. 9*b* shows the frame structure 48 and the locking bar 28 placed upside down for a better view of the connections therebetween. The locking bar 54 shown in FIG. 9*b* is in the disengaged position wherein tilting and sliding movement of the keyboard and mouse platforms 11, 12 are permitted. In this embodiment, the teeth of the teeth structure 70*a* are disengaged from the first receiving portion 92 of the locking bar 54 and are received in the notch 90 of the locking bar 52, and the teeth structure 70*b* are disengaged from the third receiving portion 93 (obstructed from view in this Figure), such that rotation of the teeth structures 70*a*, 70*b* is permitted to enable tilting movement. The second engaging portion 94 of the locking bar 54 is also disengaged from the teeth 59*a* provided on the frame structure 48, and the third engaging portion 93 (obstructed from view in this Figure) is disengaged from the teeth 59*b*, such that sliding movement of the outer frame 49 with respect to the inner structure 58 is permitted to enable sliding movement of the keyboard and mouse platforms 11, 12. In some embodiments, it is contemplated that a biasing member, such as a compression spring, may be provided on a portion of the locking bar 54 between the extensions 62 of the inner structure 58. The biasing member may be constructed and arranged to bias the locking member 54 in the engaged position.

Figure 10:
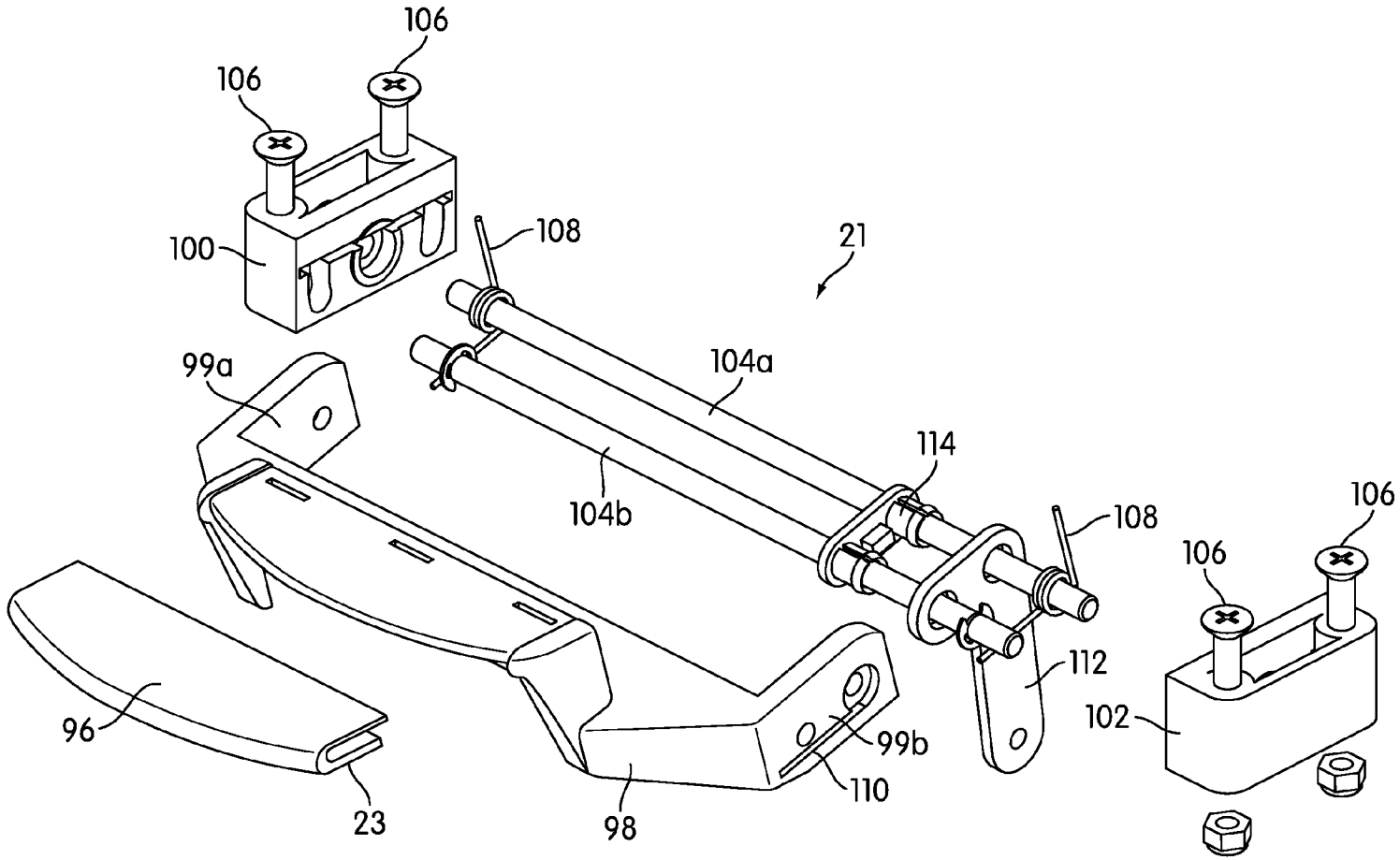
FIG. 10 is an exploded view of the handle.

FIG. 10 shows an exploded view of the handle 21 of the lock 24. The handle 21 includes an optional handle cover 96. The contact surface 23 may be defined on the handle cover 96 or on other components of the handle 21, such as a main handle portion 98. The main handle portion 98 includes a pair of legs 99*a*, 99*b* extending in opposite direction from the contact surface 23. The handle 21 also includes a first connecting portion 100 and a second connecting portion 102. The first and second connecting portions 100,102 are constructed and arranged to receive rods 104*a*, 104*b* (two are provided in this embodiment) that extends along the length of the handle 21. The first and second portions 100, 102 may be constructed and arranged to be connected to the extending legs 99*a*, 99*b* of the main handle portion 98 and may also be constructed and arranged to connect to the bottom surface 16 of the keyboard platform 12 (see FIG. 14) using screws 106, although other attachment mechanisms may be used in other embodiments. Biasing members 108 (two are provided in this embodiment) may be located on the rods 104*a*, 104*b* and may be used to bias the handle 21 in the unactuated position (and thus bias the lock 24 in the unlocked position). It should be appreciated that the biasing member 108 may be located in other parts of the keyboard and mouse support device 10 and may take various forms in other embodiments. In this embodiment, the biasing members 108 take the form of torsion springs wrapped around the rod 104*a*. One of the legs of each biasing member 108 abuts against the other rod 104*b* and may be received in a recess 110 formed in the legs 99*a*, 99*b* of the main handle portion 98. The other leg of each biasing member 108 may contact the bottom surface 16 of the keyboard platform 12 to bias the handle 21 in the unactuated position (see FIG. 14). The handle 21 is constructed and arranged to rotate along an axis defined by the rod 104*a*. The handle 21 also includes a crank 112 attached to the rods 104*a*, 104*b*, the crank 112 being constructed and arranged to connect to the locking bar 54 and to effect movement of the locking bar 54 when the handle 21 is actuated. A sleeve 114, which may be made of plastic, is provided to facilitate the connection between the crank 112 and the rods 104*a*, 104*b* and to prevent direct contact between the crank 112 and the rods 104*a*, 104*b* and between the locking bar 54 and the rods 104*a*, 104*b*.

Figure 11:
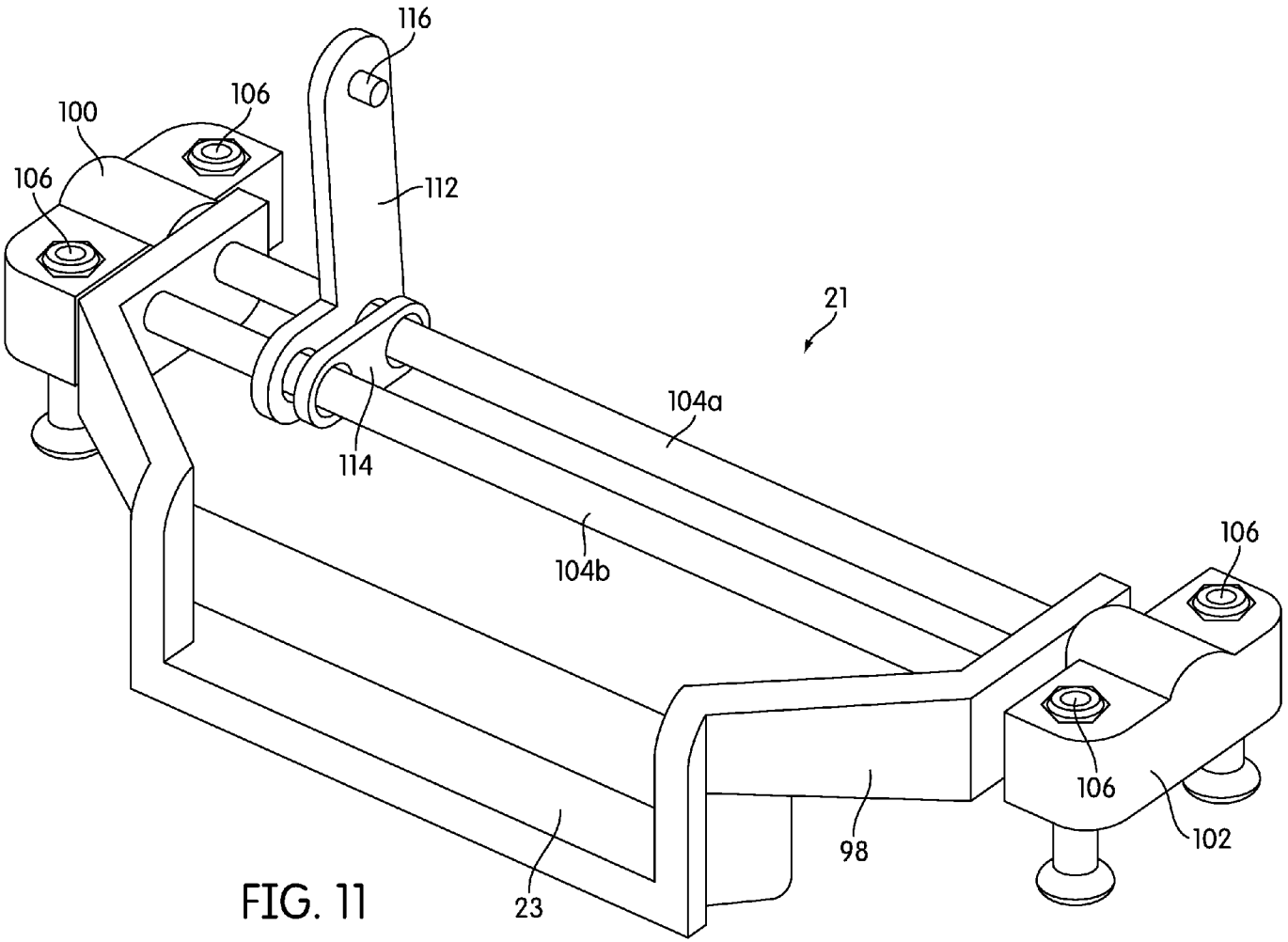
FIG. 11 is a detailed perspective view of the handle.

FIG. 11 shows the assembled handle 21. In the illustrated embodiment, the crank 112 includes a projection 116 constructed and arranged to be received in an opening 118 (see FIG. 9*a*) in the connecting portion 86 of the locking bar 54. The sleeve 114 is provided between the crank 112 and the rods 104*a*, 104*b* and facilitates the connection therebetween.

Figure 12A:
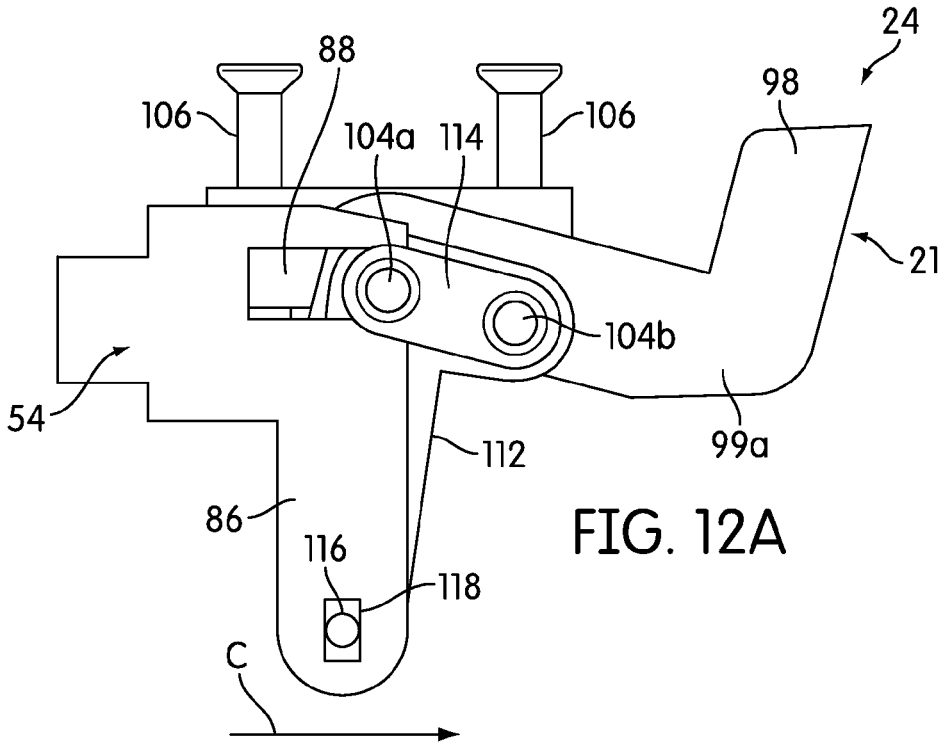
FIG. 12*a* shows the relationship between the handle and the locking bar when the handle is unactuated.
Figure 12B:
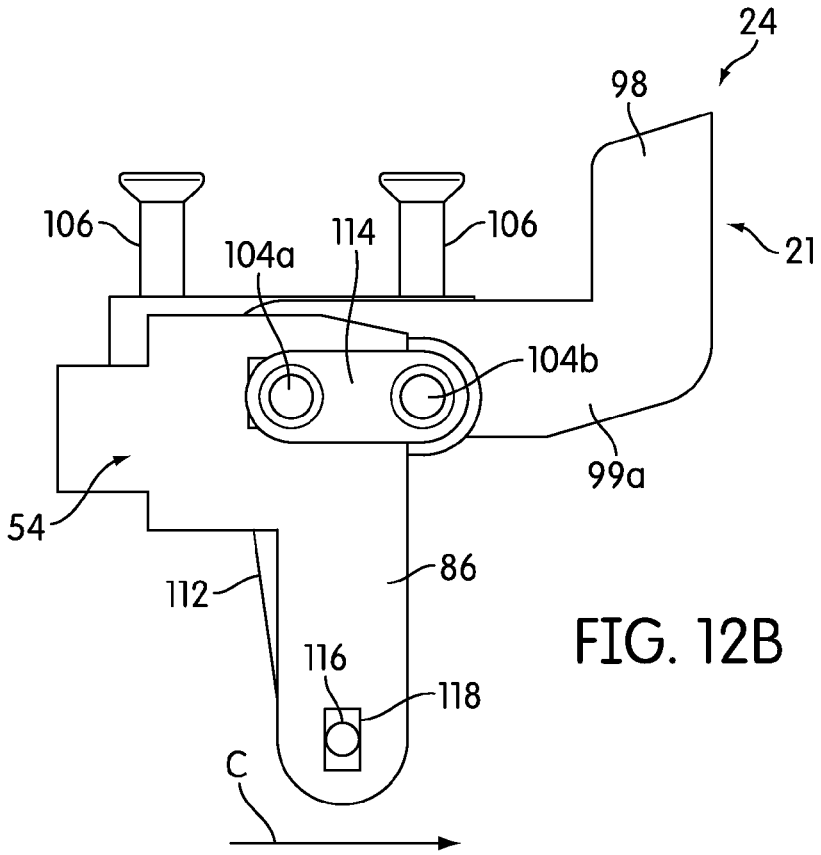
FIG. 12*b* shows the relationship between the handle and the locking bar when the handle is actuated.

FIGS. 12*a*-12*b* show a side view of portions of the lock 24, and in particular, the connection between the handle 21 and the locking member 54. FIG. 12*a* shows the handle 21 in the unactuated position and the locking member 54 in the engaged position. Accordingly, the lock 24 is considered to be in the locked position. As mentioned above, the handle 21 is biased in the unactuated position by the biasing members 108, which causes the legs 99*a*, 99*b* of the handle 21 to be angled with respect to an axis parallel to the length of the locking bar 54. The rods 104*a*, 104*b* are also vertically misaligned. That is, the rod 104*b* is lower compared to the rod 104*a*. As such, the sleeve 114 is angled with respect to the opening 88 formed in the locking bar 54 and thus movement of the locking bar 54 in the direction of C is prevented.

FIG. 12*b* shows the handle 21 in the actuated position and the locking member 54 in the disengaged position. The lock 24 is considered to be in the unlocked position. In the illustrated embodiment, the handle 21 has been pulled upwards so that the handle 21 is pivoted in the counterclockwise along the axis defined by the rod 104*a*. Accordingly, the rod 104*b* is rotated in the counterclockwise direction and is positioned higher than in FIG. 12*a*. As a result, the sleeve 114 that connects the rods 104*a*, 104*b* and the crank 112 is aligned with the opening 88 formed in the locking member 54 and thus is able to be received therein. The locking member 54, in the disengaged position, is horizontally displaced in the direction of C from its position in FIG. 12*a*. Operation of the lock 24 and movement of the components during locking and unlocking will be discussed in detail later.

Figure 13:
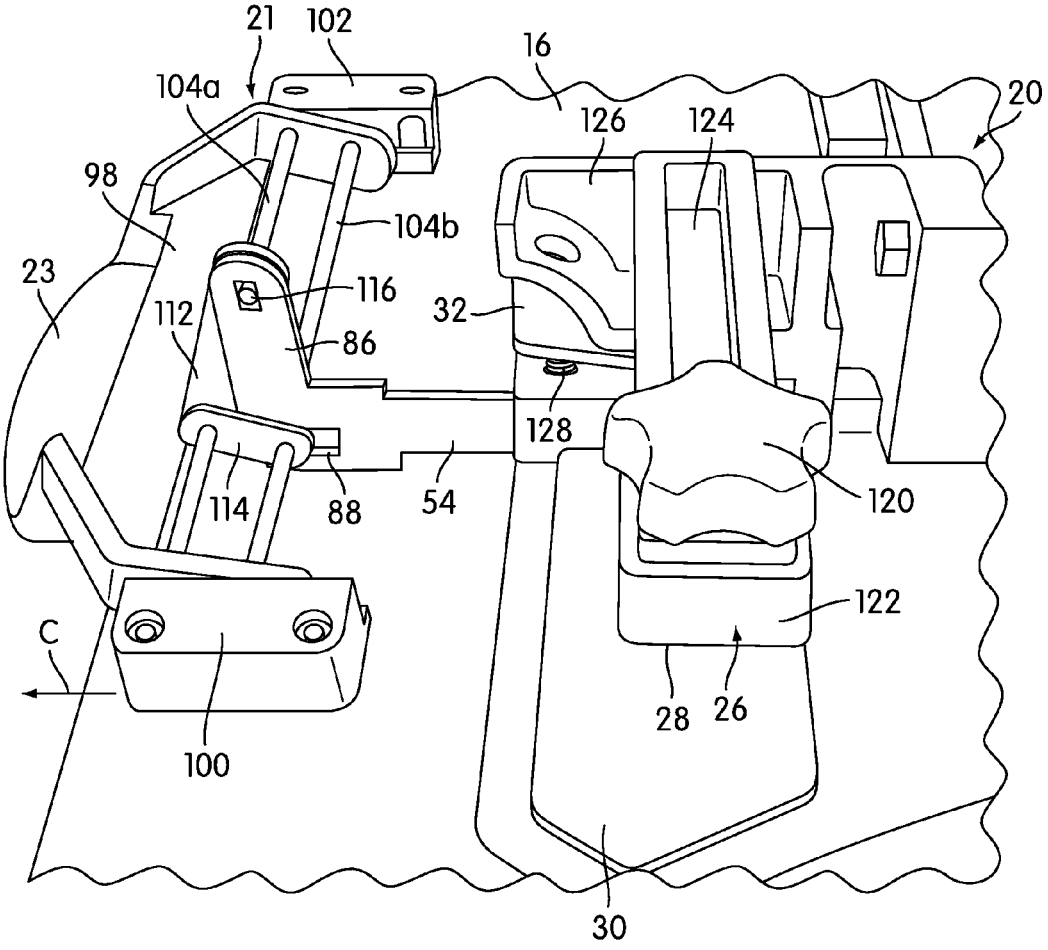
FIG. 13 is a detailed view of portions of the bottom of the keyboard and mouse support from above.

FIG. 13 is a detailed view of portions of the bottom of the keyboard and mouse support 10. That is, the keyboard and mouse support 10 is placed upside down to better reveal the components thereof. In the illustrated embodiment, the clamp 26 is provided on the bracket 20. The clamp 26 includes a rotating adjuster or actuator 120 constructed and arranged to be rotated to move the movable surface 28 closer to or further away from the fixed surface 30. In one embodiment, the movable surface 28 is defined on a cap portion 122 of the clamp 26 and rotation of the actuator 120 enables movement of the cap portion 122. As such, the rotating actuator 120 may be used to "fine tune" the distance between the movable surface 28 and the fixed surface 30. As mentioned above, actuation of the brake lever 32 to the disengaged position also permits movement of the movable surface 28 closer to or further away from the fixed surface 30. As shown in the illustrated embodiment, the clamp 26 includes an arm 124 that is received in a receiving portion 126 formed in the chassis 50. The cap portion 122 is located on one end of the arm 124. A sliding portion 125 of the arm 124 is received in an opening (not shown) formed in the brake 32, as shown in FIG. 5. Referring back to FIG. 13, a biasing member 128, which takes the form of a compression spring in this embodiment, biases the brake 32 in the engaged position such that the brake 32 is angled, rather than perpendicular, to the sliding portion 125 of the clamp 26. When the brake 32 is in the engaged position wherein the brake 32 is angled, rather than being perpendicular to the sliding portion 125 of the clamp 26, the edges of the opening of the brake 32 bind against the surface of the sliding portion 125 and thus prevents movement of the sliding portion 125. However, when the brake 32 is moved to the disengaged position by depressing the brake 32 against the bias of the biasing member 128 such that the brake 32 is perpendicular to the sliding portion 125 of the clamp 26, the opening of the brake 32 no longer binds against the sliding portion 125 and the sliding portion 125 is free to slide up and down in the opening of the clamp 26. Thus, to operate the clamp 26, the brake 32 may be depressed to move the moveable surface 28 with respect to the fixed surface 30 and the rotating actuator 120 may be rotated to "fine tune" the distance between the moveable surface 28 and the fixed surface 30. Although the illustrated embodiment of the clamp 26 shares some components with the chassis 50, it is contemplated that in other embodiments, the clamp 26 may be entirely separate from the chassis 50 or may include separate components that may be attached to the chassis 50. Just for example, the fixed surface 30 of the clamp 26 may be provided on a separate structure other than on the chassis 50.

Figure 14:
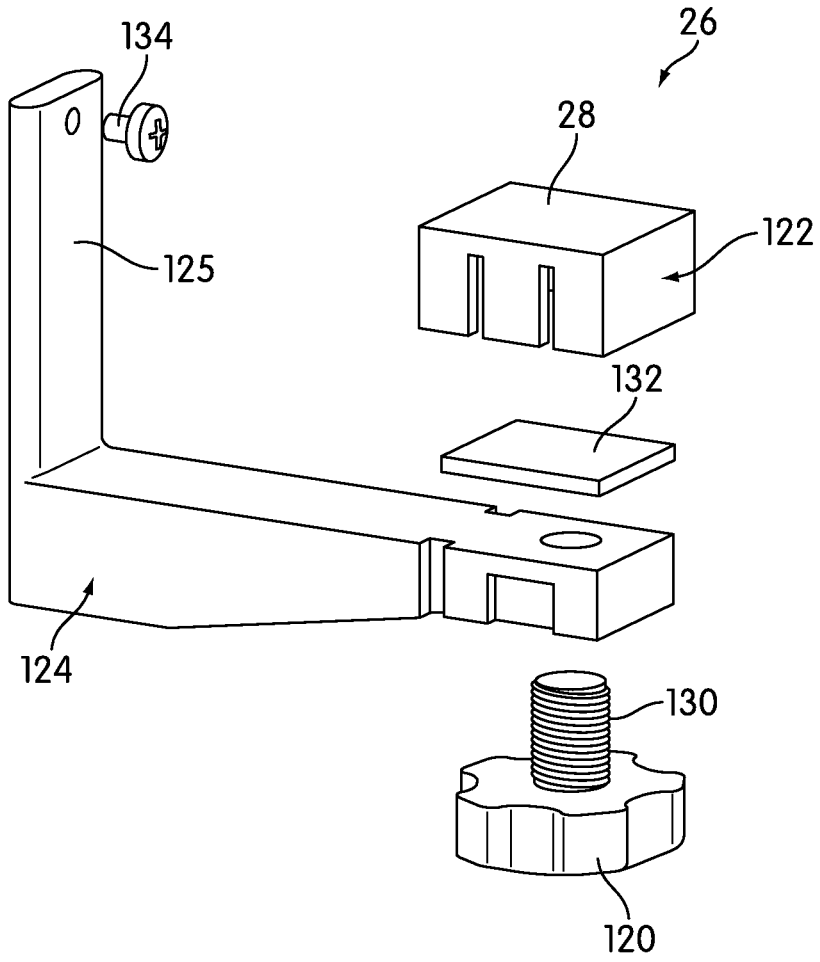
FIG. 14 is an exploded view of portions of a clamp.

FIG. 14 shows an exploded view of some components of the clamp 26. In the illustrated embodiment, the rotating actuator 120 includes a threaded portion 130 that is received in the arm 124 and in the cap portion 122. The threaded portion 130 may be constructed and arranged to abut against the cap portion 122. During "fine tuning," the rotating actuator 120 may be rotated to move the threaded portion 130 further into the arm 122 or further out of the arm 26 to control the distance between the cap portion 122 and the work surface 22. Thus, rotation of the actuator 120 may cause the cap portion 122 (and thus the moveable surface 28) to push against or move away from the work surface 22 received between the moveable surface 28 and the fixed surface 30. A spacer 132 may be provided between the cap portion 122 and the arm 124. A screw 134 or other structure may be provided on an end of the sliding portion 125 to prevent removal of the sliding portion 125 from the opening in the brake 32.

Referring back to FIGS. 4-5, the keyboard and mouse support device 10 includes the attachment structure 34 constructed and arranged to attach the mouse platform 11 to the keyboard platform 12 and to enable pivotal movement of the keyboard platform 12 between the retracted and extended positions with respect to the keyboard platform 12. As shown in FIG. 5, the attachment structure 34 includes a mouse connecting portion 136 and a keyboard connecting portion 138. The mouse connecting portion 136 is constructed and arranged to be attached to the bottom surface 15 of the mouse platform 11, and the keyboard connecting portion 138 is constructed and arranged to be attached to the bottom surface 16 of the keyboard platform 12. Linkage structures 140 (two are provided in this embodiment) pivotally connects the keyboard connecting structure 138 and the mouse connecting structure 136.

Figure 15:
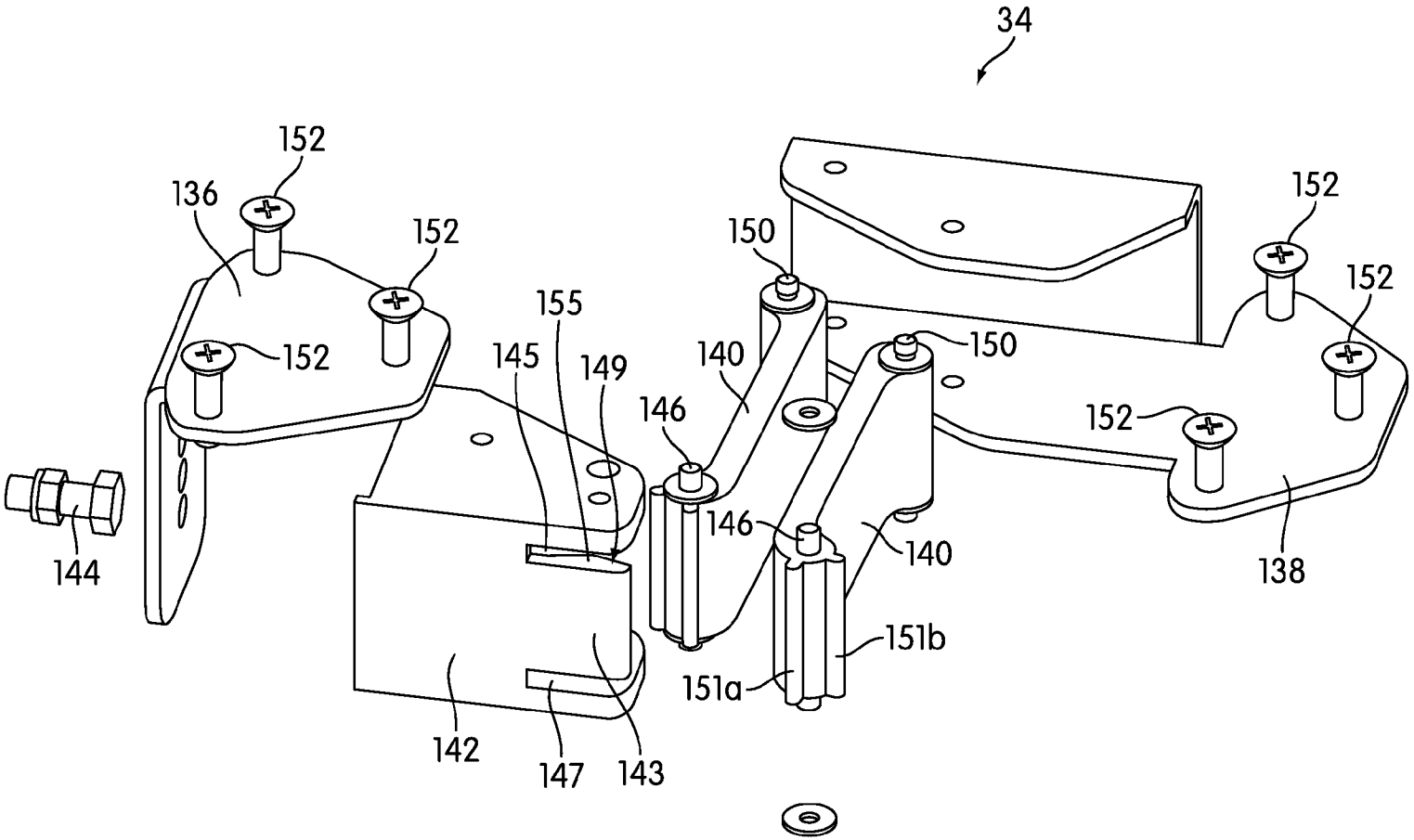
FIG. 15 is an exploded view of an attachment structure used to attach the mouse platform to the keyboard platform.

FIG. 15 is an exploded view of the attachment structure 34. In the illustrated embodiment, the attachment structure 34 includes an intermediate portion 142 constructed and arranged to pivotally connect the linkage structures 140 to the mouse connecting portion 136. For example, the intermediate portion 142 may be connected to the mouse connecting portion 136 via screws 144 or other attachment mechanisms and may receive pivot pins 146 of the linkage structures 140. The pivot pins 146 enable pivotal movement of the linkage structures 140 with respect to the mouse connecting portion 136 and the intermediate portion 142. The keyboard connecting portion 138 may also be constructed and arranged to receive pivot pins 150 of the linkage structure 140. The pivot pins 150 enable pivotal movement of the linkage structures 140 with respect to the keyboard connecting portion 138. Screws 152 or other attachment mechanisms may be used to attach the mouse connecting portion 136 to the mouse platform 11 and the keyboard connecting portion 138 to the keyboard platform 12.

In the illustrated embodiment, the intermediate portion 142 may include a lock structure 143. The lock structure 143 may be made of resilient material and may be integrally formed with the rest of the intermediate portion 142 and defined by an upper recess 145 and a lower recess 147 formed in the intermediate portion 142. It should be appreciated however, that the lock structure 143 may also be a separate piece attached to the intermediate portion 142 in other embodiments. The lock structure 143 may include an inner contact surface 149. The inner contact surface 149 may include an optional ridge portion 155 and may be constructed and arranged to contact a first flange 151*a* and a second flange 151*b* of the linkage structure 140 during pivoting movement of the mouse platform 11. That is, in the extended position, the inner contact surface 149 may contact the second flange 151*b*. Accordingly, when the mouse platform 11 is moved to and from the extended position, the contact between the inner contact surface 149 and the second flange 151*b* may provide resistance. This resistance may help "lock" or latch the mouse platform 11 in the fully extended position. Thus, to move the mouse platform 11 to and from the extended position, the user may pivot the mouse platform 11 with sufficient force to overcome the resistance provided by the contact between the inner contact surface 149 and the second flange 151*b*. In the retracted position, the inner contact surface 149 of the lock structure 143 may contact the first flange 151*a*. Accordingly, when the mouse platform 11 is moved to and from the retracted position, the contact between the inner contact surface 149 and the first flange 151*a* may provide resistance. This resistance may help "lock" or latch the mouse platform 11 in the fully retracted position. Thus, to move the mouse platform 11 to and from the retracted position, the user may pivot the mouse platform 11 with sufficient force to overcome the resistance provided by the contact between the inner contact surface 149 and the first flange 151*a*. It is contemplated that in some embodiments the lock structure 143 may flex due to its resiliency to help overcome the resistance provided by the contact between the inner contact surface 149 and the first or second flanges 151*a*, 151*b* during pivoting movement of the mouse platform 11.

Figure 16:
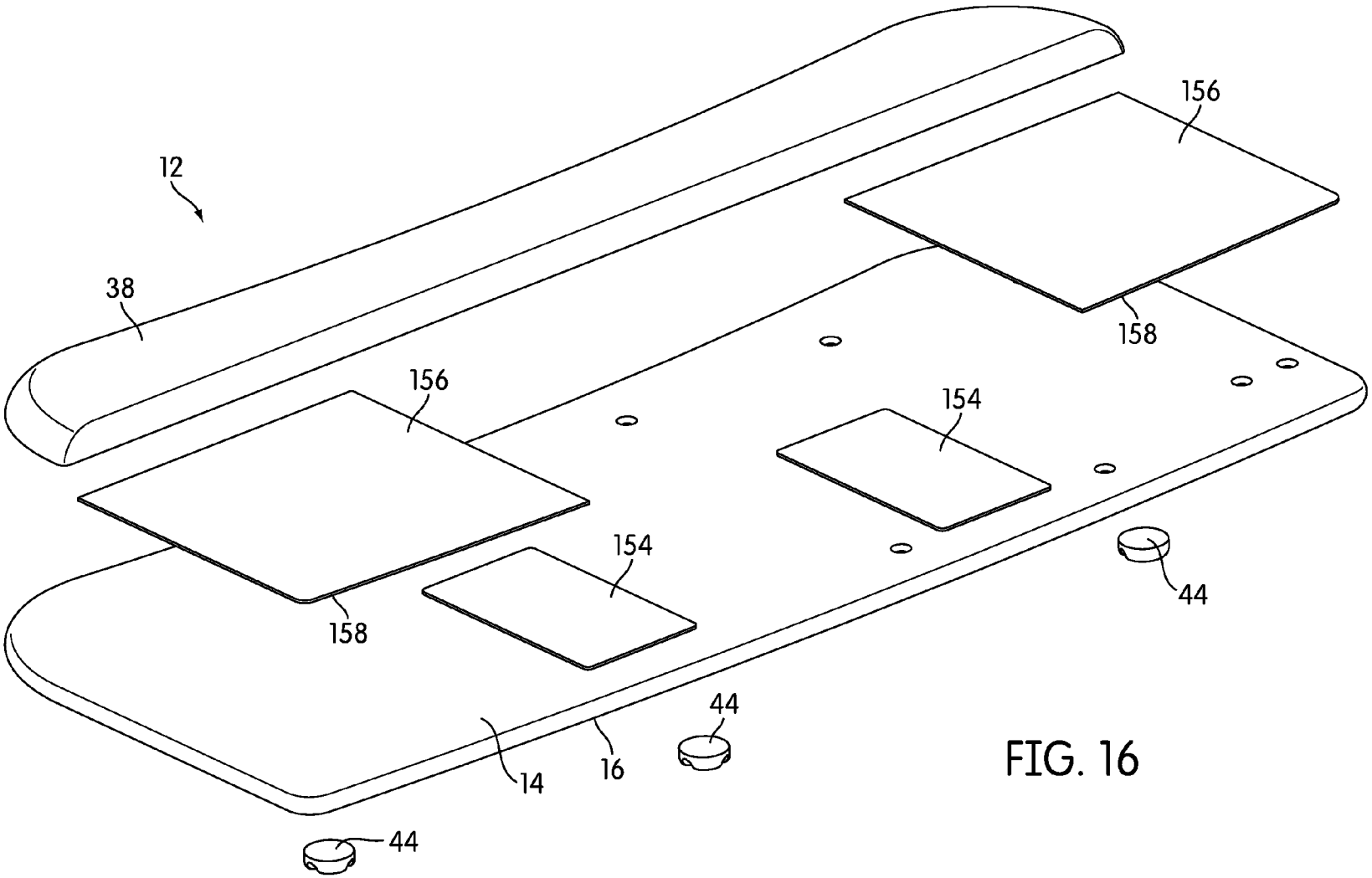
FIG. 16 is an exploded view of the keyboard platform in accordance with the embodiment of FIG. 2.

FIG. 16 is an exploded view of the keyboard platform 12 of FIG. 1*b*. Rubber pads 154 or pads made of other anti-slip material may be provided on the top surface 14 of the keyboard platform 12 to preventing slipping of the keyboard 18 during operation thereof. In this embodiment, mouse pads 156 may be provided to facilitate support for the mouse 17 and to support the mouse 17 at an angled position during operation thereof. The mouse pad 156 may be made of closed-cellular neoprene material with adhesives provided on a bottom surface 158 thereof. In one embodiment, the mouse pad 156 may be made of closed-cellular Neoprene/EPDM/SBR adhesive backed foam rubber. However, this is not intended to be limiting, and other materials may be used in other embodiments. The mouse pad 156 may be configured to support the mouse 17 at an angled position by providing sufficient friction so as to hold the mouse 17 at an angled or tilted position (see for example, FIG. 1B) without undesired sliding movement of the mouse 17 (e.g., due to gravity). That is, the upper surface 13 of the mouse platform 11 on which the mouse 17 is supported may be tilted or positioned at a certain angle relative to a horizontal plane, and thus the mouse 17 may also be tilted or angled as such relative to the horizontal plane. However, it should be appreciated that during operation of the mouse 17, the mouse platform 11 may also be positioned such that the upper surface 13 of the mouse platform 11 is parallel with a horizontal plane. In some embodiments, the pads 154 of the keyboard platform 12 may be made of the same material as the mouse pads 156. Thus, the pads 154 of the keyboard platform 12 may also be configured to support the keyboard 18 at a tilted position and prevent undesired sliding movement thereof. It should be appreciated that the number and location of the pads 154, 156 may vary in other embodiments. The contoured wrist support 38 may be made of memory foam material, or other materials, for enhanced user comfort. Wire routers 44 may be provided on the bottom surface 16 of the keyboard platform 16 to route wires from the keyboard 18. Any combination of the components shown in this Figure may also be provided in the keyboard and mouse support device 10 embodiment of FIG. 1*a*.

Figure 17:
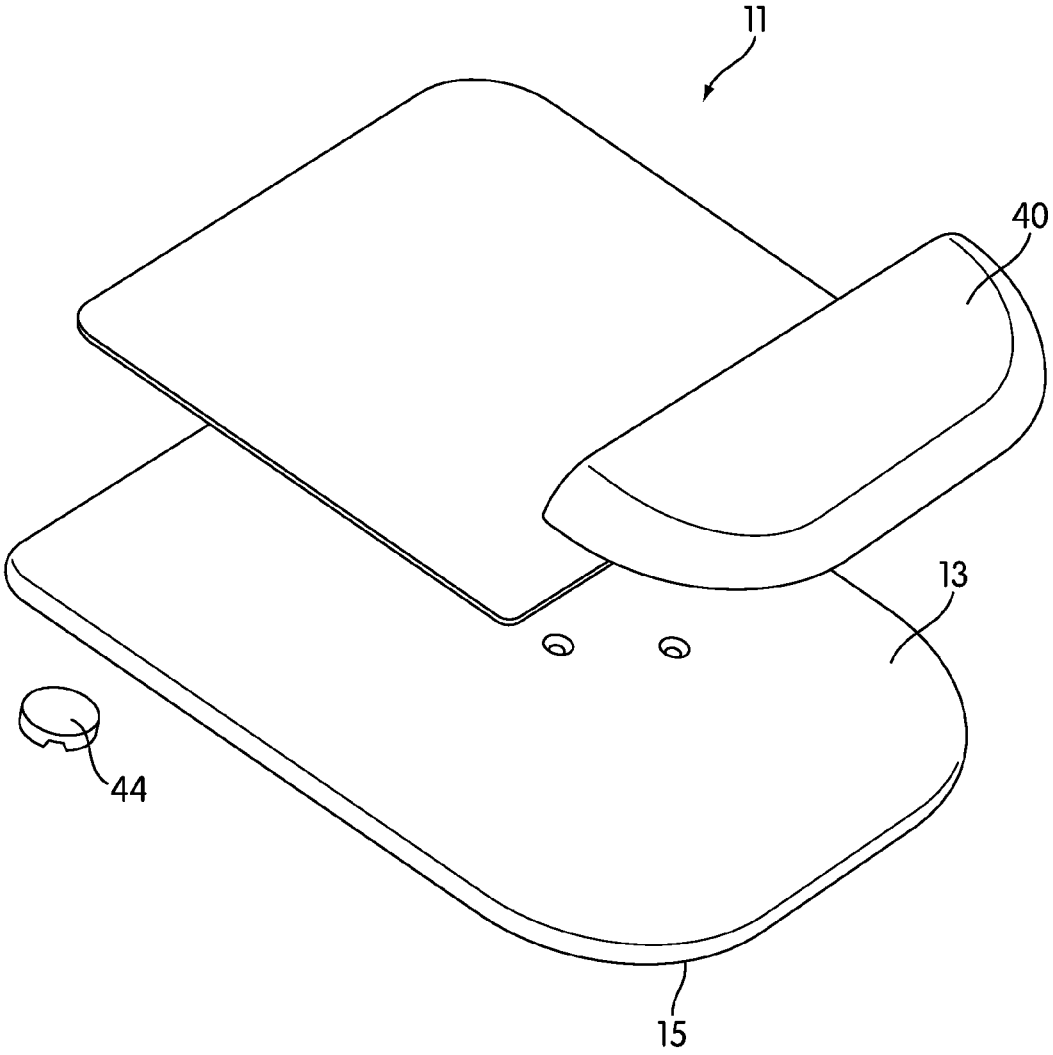
FIG. 17 is an exploded view of the mouse platform.

FIG. 17 is an exploded view of the mouse platform 11. The mouse platform 11 includes the mouse pad 156, which may be made of neoprene or other materials. The contoured wrist support 40 may be made of memory foam or other materials. The wire router 44 may be provided on the bottom surface 15 of the mouse platform 11 to route wires from the mouse 17.

The keyboard and mouse support device 10 may be installed on the work surface 22 as follows in accordance with an embodiment. The keyboard and mouse support device 10 may be placed above the work surface 22 such that the edge 42 of the work surface 22 is positioned between the fixed surface 30 and the movable surface 28 of the clamps 26. The clamps 26 may then be adjusted such that the work surface 22 is secured between the fixed surface 30 and the movable surface 28. To adjust the clamp 26, the user may depress the brake 32 against the bias of the biasing member 128 (see FIG. 3) until the brake 32 is perpendicular to the sliding portion 125 of the clamp 26. Accordingly, the opening of the brake 32 in which the sliding portion 125 is received is no longer binding against the sliding portion 125 and the sliding portion 125 is free to move in the opening. The user may then slide the sliding portion 125 in the opening of the brake 32 to move the moveable surface 28 closer to the fixed surface 30 such that the work surface 22 is clamped therebetween. Once the desired position of the arm 124 (see FIG. 13) has been selected, the user may cease depression or actuation of the brake 32, whereupon the biasing member 128 snaps the brake 32 back to the angled position such that the brake 32 is no longer perpendicular to the sliding portion 125. The sliding portion 125 is thus again prevented from sliding movement because of the binding engagement between the sliding portion 125 and the opening in the brake 32. The user may then rotate the rotating actuator 120 to "fine tune" the adjustment such that the moveable surface 28 is moved closer to the fixed surface 30 to further secure the work surface 22 therebetween. Rotation of the rotating actuator 120 may further push the cap portion 122 and the moveable surface 28 that is defined thereon towards the work surface 22 without requiring the use of the sliding portion 125.

To remove the keyboard and mouse support device 10 from the work surface 22, the user may optionally rotate the rotating actuator 120 in the opposite direction to decrease the amount of force with which the cap portion 122 and the moveable surface 28 is pushing against the work surface 22. However, the rotation of the rotating actuator 120 is not required, and the user may simply actuate or depress the brake 32 to move the brake 32 to the disengaged position wherein the brake 32 is perpendicular to the sliding portion 125. The user may then slide the sliding portion 125 until the moveable surface 28 is sufficiently spaced from the fixed surface 30 to remove the work surface 22 from therebetween. After the moveable surface 28 is sufficiently spaced from the moveable surface 30 to remove the work surface 22 from therebetween, the user may cease actuation or depression of the brake 32, whereupon the biasing member 128 may snap the brake 32 back to its angled, engaged position shown in FIG. 5.

The keyboard and mouse support device 10 may be tilted or slid as follows in accordance with an embodiment. After the keyboard and mouse support device 10 has been clamped onto the work surface as shown in FIG. 3, the user may adjust the distance between the user and the keyboard and mouse platforms 11, 12 and the tilt angle of the keyboard and mouse platforms 11, 12. The lock 24 may initially be in the locked position, and the handle 21 may be in the unactuated, default position shown in FIG. 13. When the lock 24 is in the locked position, the second engaging portion 94 and third engaging portion 93 of the locking bar 54 are engaged with the teeth 59*a*, 59*b*, provided on the frame structure 48, respectively, to prevent sliding movement thereof, as shown in FIG. 8. As mentioned above, the keyboard platform 12 is attached to the outer structure 49 and the rods of the outer structure 49 are slidingly received in the mounting structure 74. The locking bar 54, which is connected to the mounting structure 74, the inner structure 58, and the handle 21, is engaged with the teeth 59*a*, 50*b* of the outer structure 49, and thus the outer structure 49 is prevented from sliding the rods 60 thereof along the mounting structure 74 to effect sliding movement of the keyboard platform 12. As also mentioned above, the mounting structure 74 is attached to the inner structure 58 and the inner structure 58 is pivotally attached to the chassis 50. The chassis 50 is held stationary by its attachment to the work surface 22 via the clamps 26. When the lock 24 is in the locked position, the first engaging portion 92 and the third engaging portion 93 of the locking bar 54 are engaged with the teeth of the teeth structures 70*a*, 70*b*, respectively, to prevent pivoting of the frame structure 48 relative to the chassis 50. The reinforcement structure 71 may be in the engaged position wherein the end cap 79 and/or the inner structure 58 are pushed against the bottom surface 16 of the keyboard platform 12 with sufficient force so as to provide enough friction to stabilize the keyboard and mouse support device 10. As mentioned above, to permit sliding movement of the keyboard platform 12 when the lock 24 is in the unlocked position, the reinforcement structure 71 should be in the disengaged position. Accordingly, to move the reinforcement structure 71 to the disengaged position, the user may rotate the head portion 83 (e.g., in the clockwise direction) so as to move the threaded portion 75 and the end cap 79 away from the bottom surface 16 of the keyboard platform 12.

To move the lock 24 to the unlocked position and thus move the locking bar 54 to the disengaged position, the user may actuate the handle 21 by pulling the handle 21 upwards using the contact surface 23 thereon against the bias of the biasing members 108. Referring to FIG. 12*a*, the pivoting movement of the handle 21 upwards may cause the rod 104*b* to be rotated in the counterclockwise direction relative to the rod 104*a* and as such, the sleeve 114 may be moved from its angled position shown in FIG. 12*a* to its position shown in FIG. 12*b* wherein the sleeve 114 is aligned with the opening 88. The pivoting of the handle 21 and rotation of the rod 104*b* moves the projection 116 of the crank 112 (i.e., the projection 116 of the crank 112) in the direction C. Accordingly, the connecting portion 86 of the locking bar 54 is also moved in the direction of C by the engagement between the projection 116 of the crank 112 and the opening 118 formed in the connecting portion 86. As a result, the locking bar 54 is pulled in the direction of C and the sleeve 114, which is aligned with the opening 88 of the locking bar 54, is received in the opening 88 formed therein, as shown in FIG. 12*b*. The movement of the locking bar 54 in the direction of C moves the second engaging portion 94 out of engagement with the teeth 59*a*, the third engaging portion 93 out of engagement with the teeth 59*a* and the teeth structure 70*b*, and the first engaging portion 92 out of engagement with teeth structures 70*a* such that the teeth structures 70*a* are instead received in the notch 90 in the locking bar 54, as shown in FIG. 9*b*. Accordingly, the locking bar 54 and the outer frame 49 are free to rotate with respect to the teeth structures 70*a*, 70*b* to enable tilting movement of the keyboard and mouse platforms 11, 12. Furthermore, the outer structure 49 and the rods 60 thereof may be slid along the mounting structure 74 and the inner structure 58 to effect sliding movement of the keyboard and mouse platforms 11, 12 along the fore-aft axis A. The frame structure 48 may be rotated relative to the chassis 50 to effect tilting movement of the keyboard and mouse platforms 11, 12.

After the desired position along the fore-aft axis A has been selected and the desired tilting angle has been selected, the user may cease actuation of the handle 21, whereupon the biasing members 108 snaps the handle 21 downward to the position shown in FIG. 12*a*. Accordingly, the rod 104*b* is rotated in the clockwise direction relative to the rod 104*a*. As such, the sleeve 114 is removed from the opening 88 of the locking bar 54 (see FIG. 12*a*) and is returned to its angled position shown in FIG. 12*a*. The crank 112 is moved in the direction opposite of C and is no longer pulling the locking bar 54 in the direction of C. The angled position of the sleeve 112 may help return the locking bar 54 to the engaged position by pushing the locking bar 54 in the direction opposite of C. As a result, the locking bar 54 is moved back to the engaged position wherein the first engaging portion 92 of the locking bar 54 is engaged with the teeth structure 70*a*, the second engaging portion 94 of the locking bar 54 is engaged with the teeth 59*a*, and the third engaging portion 93 is engaged with the teeth 59*b* and the teeth structure 70*b*. Accordingly, the lock 24 is in the locked position wherein tilting and sliding movement of the keyboard and mouse platforms 11, 12 are prevented. The user may then move the reinforcement structure 71 to the engaged position by rotating the head portion 83 thereof (e.g., in the counterclockwise direction). Accordingly, the threaded portion 75 may be further received in the threaded opening 81 and may push the end cap 79 and/or the inner structure 58 against the bottom surface 16 of the keyboard platform 12 so as to stabilize the keyboard and mouse support device 10.

To adjust the distance of the mouse platform 11 from the keyboard platform 12, the mouse platform 11 may be moved between the extended (see FIG. 5) and retracted positions (see FIG. 4). To pivot the mouse platform 11 from the retracted position shown in FIG. 4 to the extended position shown in FIG.5, the user may grab a portion of the mouse platform 11 and pull in a direction away from the keyboard platform 12. Accordingly, the linkage structures 140 may pivot at the pivot pins 150 and also at the pivot pins 152 to move the mouse platform 11 to the extended position shown in FIG. 5. In the embodiment shown in FIGS. 4-5, during pivoting movement, the linkage structure 140 may move the mouse connecting portion 136, which is attached to the mouse platform 11, in a counterclockwise direction with respect to the keyboard connecting portion 138 until the mouse platform 11 is in the position shown in FIG. 5.

To move the mouse platform 11 from the extended position shown in FIG. 5 to the retracted position shown in FIG. 4, the user may push the mouse platform 11 towards the keyboard platform 12 so that the mouse platform 11 is pivoted via the linkage structures 140. The linkage structures 140 may move the mouse connecting portion 136, which is attached to the mouse platform 11, in a clockwise direction with respect to the keyboard connecting portion 138. until the mouse platform 11 is in the position shown in FIG. 4

It is contemplated that any of the components above may be made of plastic, metal, wood, rubber, other materials, or any combination thereof The examples described above are not intended to be limiting, and it is contemplated that any combination of the components or additional components may be provided in other embodiments.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A support device comprising:

a keyboard platform having a top keyboard receiving surface and a bottom surface, the top keyboard receiving surface being configured to support a computer keyboard;

a bracket constructed and arranged to mount the keyboard platform to an edge of a work surface with the top keyboard receiving surface facing upwardly such that at least part of the bottom surface of the keyboard platform is elevated above and over at least a portion of the work surface, the keyboard platform being mounted on the bracket for sliding movement with respect to the edge of the work surface along a substantially horizontal fore-aft axis, the keyboard platform being further mounted on the bracket for tilting movement about a tilting axis substantially perpendicular to the fore-aft axis; and a lock movable between a locked position wherein sliding and tilting movement of the keyboard platform with respect to the edge of the work surface is prevented and an unlocked position wherein sliding and tilting movement of the keyboard platform with respect to the edge of the work surface is permitted.

2. The support device of claim 1, wherein the lock comprises a locking bar moveable between 1) an engaged position wherein the locking bar is engaged to engaging members of the bracket to prevent the sliding movement and tilting movement of the keyboard platform to provide the locked position and 2) a disengaged position wherein the locking bar is disengaged from the engaging members of the bracket to permit the sliding and/or tilting movement of the keyboard platform to provide the unlocked position.

3. The support device of claim 2, wherein the locking bar is biased into the engaged position.

4. The support device of claim 2, wherein the bracket comprises a tilting portion constructed and arranged to enable tilting movement of the keyboard platform, the locking bar constructed and arranged to engage with the tilting portion in the engaged position to prevent tilting movement of the keyboard platform and disengage from the tilting position in the disengaged position to permit the tilting movement of the keyboard platform.

5. The support device of claim 4, wherein the tilting portion comprises a plurality of teeth constructed and arranged to engage with the locking bar in the engaged position to prevent tilting movement of the keyboard platform when the lock structure is in the locked position.

6. The support device of claim 2, wherein the bracket comprises a sliding portion constructed and arranged to enable sliding movement of the keyboard platform.

7. The support device of claim 6, wherein the sliding portion comprises a plurality of ridges constructed and arranged to engage with the locking bar to prevent sliding movement of the keyboard platform when the lock structure is in the locked position.

8. The support device of claim 7, wherein the bracket comprises a tilting portion constructed and arranged to enable tilting movement of the keyboard platform, the locking bar constructed and arranged to engage with the tilting portion in the engaged position to prevent tilting movement of the keyboard platform and disengage from the tilting position in the disengaged position to permit the tilting movement of the keyboard platform.

9. The support device of claim 7, wherein the tilting portion comprises a plurality of teeth constructed and arranged to engage with the locking bar in the engaged position to prevent tilting movement of the keyboard platform when the lock structure is in the locked position.

10. The support device of claim 1, wherein the lock comprises a handle engageable by the user to move the lock between the locked and unlocked positions.

11. The support device of claim 1, further comprising a mouse platform having an upper surface upon which a computer mouse can be operated and a lower surface.

12. The support device of claim 11, wherein the mouse platform is integral with the keyboard platform.

13. The support device of claim 11, wherein the mouse platform is fixed to the keyboard platform.

14. The support device of claim 11, wherein the mouse platform comprises a neoprene material on the upper surface thereof.

15. The support device of claim 11, wherein the mouse platform comprises a Neoprene/EPDM/SBR foam rubber material provided on the upper surface thereof to support the computer mouse at an angled position.

16. The support device of claim 11, wherein the mouse platform is pivotally attached to the keyboard platform, the mouse platform being pivotable between a retracted position wherein the mouse platform is positioned above a portion of the keyboard platform and an extended position wherein the mouse platform is horizontally displaced relative to the keyboard platform.

17. A support device comprising:

a keyboard platform having a top keyboard receiving surface and a bottom surface, the top keyboard receiving surface being configured to support a computer keyboard;

a bracket constructed and arranged to mount the keyboard platform to a work surface with the top keyboard receiving surface facing upwardly;

a clamp provided on the bracket and engageable with the work surface such that the bracket is operable to position at least part of the bottom surface of the keyboard platform elevated above and over at least portion of the work surface, the clamp comprising:

at least a pair of opposing surfaces for receiving an edge of the work surface therebetween, at least one of said opposing surfaces being movable to enable relative clamping movement of the opposing surfaces towards one another to clamp the edge of the work surface therebetween, and relative releasing movement of the opposing surfaces away from one another to unclamp the edge of the work surface;

a brake constructed and arranged to be moveable between an engaged position and a disengaged position, wherein the brake when in the engaged position permits the relative clamping movement of the opposing surfaces towards one another and prevents the relative releasing movement of the opposing surfaces away from one another, and wherein the brake when in the disengaged position permits the relative clamping movement of the opposing surfaces towards one another and permits the relative releasing movement of the opposing surfaces away from the one another, and an adjuster configured to move the opposing surfaces towards one another independent of operation of the brake.

18. The support device of claim 17, wherein the pair of opposing surfaces comprises a moveable surface and a fixed surface.

19. The support device of claim 18, wherein the clamp is further constructed and arranged such that the moveable surface is positioned below the work surface and the fixed surface is positioned above the work surface when the work surface is received between the movable and fixed surfaces.

20. The support device of claim 17, wherein the brake comprises a lever.

21. The support device of claim 17, wherein the clamp is positioned below the bracket when the keyboard support device is mounted to the work surface.

22. The support device of claim 17, wherein the keyboard platform is mounted on the bracket for sliding movement with respect to the edge of the work surface along a substantially vertical plane, and wherein the keyboard platform is further mounted on the bracket for tilting movement with respect to the edge of the work surface.

23. The support device of claim 22, further comprising a lock movable between a locked position wherein sliding and tilting movement of the keyboard platform with respect to the edge of the work surface is prevented and an unlocked position wherein sliding and tilting movement of the keyboard platform with respect to the edge of the work surface is permitted.

24. The support device of claim 23, wherein the lock comprises a locking bar moveable between 1) an engaged position wherein the locking bar is engaged to engaging members of the bracket to prevent the sliding movement and tilting movement of the keyboard platform to provide the locked position and 2) a disengaged position wherein the locking bar is disengaged from the engaging members of the bracket to permit the sliding and/or tilting movement of the keyboard platform to provide the unlocked position.

25. The support device of claim 17, wherein the brake is biased in the engaged position and is constructed and arranged to be depressed against the bias to move the brake to the disengaged position.

26. The support device of claim 17, further comprising a mouse platform having an upper surface upon which a computer mouse can be operated and a lower surface.

27. The support device of claim 26, wherein the mouse platform is attached to the keyboard platform and positioned at an elevated height relative to the keyboard platform.

28. The support device of claim 26, wherein the mouse platform is integral with the keyboard platform.

29. The support device of claim 26, wherein the mouse platform is fixed to the keyboard platform.

30. The support device of claim 26, wherein the mouse platform comprises a neoprene material on the upper surface thereof.

31. The support device of claim 26, wherein the mouse platform comprises a Neoprene/EPDM/SBR foam rubber material provided on the upper surface thereof to support the computer mouse at an angled position.

32. The support device of claim 26, wherein the mouse platform is pivotally attached to the keyboard platform, the mouse platform being pivotable between a retracted position wherein the mouse platform is positioned above a portion of the keyboard platform and an extended position wherein the mouse platform is horizontally displaced relative to the keyboard platform.

33. A support device comprising:

a keyboard platform having a top keyboard receiving surface and a bottom surface, the top keyboard receiving surface being configured to support a computer keyboard;

a bracket constructed and arranged to mount the keyboard platform to a work surface with the top keyboard receiving surface facing upwardly;

a clamp provided on the bracket and engageable with the work surface such that the bracket is operable to position at least part of the bottom surface of the keyboard platform elevated above and over at least portion of the work surface, the clamp comprising:

at least a pair of opposing surfaces for receiving an edge of the work surface therebetween, at least one of said opposing surfaces being movable to enable relative clamping movement of the opposing surfaces towards one another to clamp the edge of the work surface therebetween, and relative releasing movement of the opposing surfaces away from one another to unclamp the edge of the work surface;

a brake constructed and arranged to be moveable between an engaged position and a disengaged position, wherein the brake when in the engaged position permits the relative clamping movement of the opposing surfaces towards one another and prevents the relative releasing movement of the opposing surfaces away from one another, and wherein the brake when in the disengaged position permits the relative clamping movement of the opposing surfaces towards one another and permits the relative releasing movement of the opposing surfaces away from the one another, wherein the brake is biased in the engaged position and is constructed and arranged to be depressed against the bias to move the brake to the disengaged position.

34. The support device of claim 33, wherein the pair of opposing surfaces comprises a moveable surface and a fixed surface.

35. The support device of claim 33, wherein the clamp is positioned below the bracket when the keyboard support device is mounted to the work surface.

36. The support device of claim 33, wherein the keyboard platform is mounted on the bracket for sliding movement with respect to the edge of the work surface along a substantially vertical plane, and wherein the keyboard platform is further mounted on the bracket for tilting movement with respect to the edge of the work surface.

37. The support device of claim 36, further comprising a lock movable between a locked position wherein sliding and tilting movement of the keyboard platform with respect to the edge of the work surface is prevented and an unlocked position wherein sliding and tilting movement of the keyboard platform with respect to the edge of the work surface is permitted.

38. The support device of claim 33, further comprising a mouse platform having an upper surface upon which a computer mouse can be operated and a lower surface.

39. The support device of claim 38, wherein the mouse platform is pivotally attached to the keyboard platform, the mouse platform being pivotable between a retracted position wherein the mouse platform is positioned above a portion of the keyboard platform and an extended position wherein the mouse platform is horizontally displaced relative to the keyboard platform.

* * * * *